US011739606B2

(12) United States Patent
Sherman et al.

(10) Patent No.: US 11,739,606 B2
(45) Date of Patent: Aug. 29, 2023

(54) TEMPORARY WELL ISOLATION DEVICE

(71) Applicant: Terves, LLC, Euclid, OH (US)

(72) Inventors: Andrew Sherman, Mentor, OH (US); Brian Doud, Euclid, OH (US); Nicholas Farkas, Euclid, OH (US); Kurt Gilbert, Euclid, OH (US)

(73) Assignee: Terves, LLC, Euclid, OH (US)

( * ) Notice: Subject to any disclaimer, the term of this patent is extended or adjusted under 35 U.S.C. 154(b) by 0 days.

(21) Appl. No.: 17/880,384

(22) Filed: Aug. 3, 2022

(65) Prior Publication Data

US 2022/0372832 A1 Nov. 24, 2022

Related U.S. Application Data

(63) Continuation of application No. 16/992,483, filed on Aug. 13, 2020, now Pat. No. 11,459,846.

(60) Provisional application No. 62/886,682, filed on Aug. 14, 2019.

(51) Int. Cl.

| | |
|---|---|
| ***E21B 33/02*** | (2006.01) |
| ***E21B 33/12*** | (2006.01) |
| ***E21B 29/02*** | (2006.01) |

(52) U.S. Cl.

CPC ..... *E21B 33/12* (2013.01); *E21B 29/02* (2013.01); *E21B 2200/08* (2020.05)

(58) Field of Classification Search

CPC ..... E21B 33/12; E21B 29/02; E21B 2200/08; E21B 34/063

See application file for complete search history.

(56) References Cited

U.S. PATENT DOCUMENTS

| | | | | |
|---|---|---|---|---|
| 4,613,394 | A * | 9/1986 | Terrell | B26F 3/00 156/345.19 |
| 5,261,488 | A * | 11/1993 | Gullet | E21B 17/1028 166/241.7 |
| 5,924,696 | A * | 7/1999 | Frazier | E21B 34/063 277/336 |
| 6,026,903 | A * | 2/2000 | Shy | E21B 23/00 166/192 |
| 7,513,311 | B2 * | 4/2009 | Gramstad | E21B 34/063 166/317 |
| 7,775,286 | B2 * | 8/2010 | Duphorne | E21B 34/063 166/376 |
| 8,528,633 | B2 * | 9/2013 | Agrawal | E21B 23/04 166/193 |
| 8,573,295 | B2 * | 11/2013 | Johnson | E21B 29/02 166/193 |
| 8,584,746 | B2 * | 11/2013 | Marya | E21B 33/12 166/192 |
| 9,068,428 | B2 * | 6/2015 | Mazyar | E21B 23/04 |
| 9,441,446 | B2 * | 9/2016 | Fripp | E21B 29/02 |

(Continued)

*Primary Examiner* — Steven A MacDonald

(74) *Attorney, Agent, or Firm* — Ulmer & Berne LLP; Brian E. Turung

(57) ABSTRACT

A temporary well isolation device which has an axial passage that comprises a temporary housing having an internal cavity containing a chemical material and a temporary barrier or plug member that can be actuated by an external mechanism to allow fluid to flow into the internal chamber and contact the chemical material in the internal chamber. When the chemical material is exposed to fluid, the chemical material causes the temporary housing to corrode, dissolve, and/or degrade.

22 Claims, 7 Drawing Sheets

(56) References Cited

U.S. PATENT DOCUMENTS 9,689,227 B2 * 6/2017 Fripp ..... E21B 33/1208
9,732,579 B2 * 8/2017 Hiorth ..... E21B 33/1208
9,833,838 B2 * 12/2017 Mazyar ..... B22F 1/025
10,107,070 B2 * 10/2018 Yong ..... H04L 67/42
10,309,183 B2 * 6/2019 Cutler ..... E21B 43/261
10,422,199 B1 * 9/2019 Subbaraman ..... E21B 33/1293
10,669,808 B1 * 6/2020 Rosenholm ..... E21B 43/261
2004/0000406 A1 * 1/2004 Allamon ..... E21B 23/04 166/240
2007/0181224 A1 * 8/2007 Marya ..... C22C 30/06 148/400
2008/0105438 A1 * 5/2008 Jordan ..... C22C 30/04 166/376
2008/0149345 A1 * 6/2008 Marya ..... E21B 23/00 166/376
2010/0175867 A1 * 7/2010 Wright ..... E21B 23/04 166/57
2010/0270031 A1 * 10/2010 Patel ..... E21B 33/1208 166/376
2011/0186306 A1 * 8/2011 Marya ..... E21B 33/12 166/386
2012/0118583 A1 * 5/2012 Johnson ..... E21B 29/02 166/376
2012/0168152 A1 * 7/2012 Casciaro ..... E21B 44/00 166/250.03
2012/0306025 A1 12/2012 Becker
2013/0240200 A1 * 9/2013 Frazier ..... E21B 33/134 166/135
2013/0333891 A1 * 12/2013 Fripp ..... E21B 29/02 166/302
2014/0338923 A1 * 11/2014 Fripp ..... E21B 33/1208 166/376
2015/0060085 A1 * 3/2015 Xu ..... E21B 29/02 166/376
2015/0239795 A1 * 8/2015 Doud ..... C06B 45/18 428/649
2015/0285026 A1 * 10/2015 Frazier ..... E21B 33/134 166/120
2016/0177655 A1 * 6/2016 Fripp ..... E21B 33/128 166/376
2016/0281455 A1 * 9/2016 Brandsdal ..... E21B 33/12
2016/0333655 A1 * 11/2016 Fripp ..... E21B 29/02
2017/0022778 A1 * 1/2017 Fripp ..... E21B 33/134
2017/0022783 A1 * 1/2017 Yong ..... H04L 41/0266
2017/0284167 A1 * 10/2017 Takahashi ..... B32B 27/20
2018/0087369 A1 * 3/2018 Sherman ..... G01N 33/24
2018/0306027 A1 * 10/2018 Sherman ..... E21B 29/02
2018/0334607 A1 * 11/2018 Paxson ..... C09K 8/44
2020/0080396 A1 * 3/2020 Subbaraman ..... E21B 34/063
2021/0047895 A1 * 2/2021 Sherman ..... E21B 33/12

* cited by examiner

TEMPORARY WELL ISOLATION DEVICE

The present disclosure is continuation of U.S. patent application Ser. No. 16/992,483 filed Aug. 13, 2020, which in turn claims priority on U.S. Provisional Application Ser. No. 62/886,682 filed Aug. 14, 2019, which are incorporated herein by reference.

TECHNICAL FIELD OF THE DISCLOSURE

The present disclosure pertains to a temporary well isolation device, particularly to a temporary well isolation device having an axial passage that comprises a temporary barrier with a cavity containing a chemical material that is actuated by an external mechanism, and more particularly to a temporary well isolation device having an axial passage that includes a temporary barrier, and wherein the axial passage connects to a self-contained cavity containing a chemical material, and wherein the temporary barrier can be actuated by an external mechanism to cause exposure of the chemical material in the self-contained cavity to a fluid which results in the chemical material causing the body of the temporary well isolation device to at least partially corrode, dissolve, and/or degrade.

BACKGROUND OF THE DISCLOSURE

In a production well, a production string formed of production tubing and tooling is used to transport a production fluid containing hydrocarbons from a downhole formation to the surface of the well. During the completion of the well, there are situations wherein a temporary isolation barrier is needed along the production string that is to be formed without using tooling from the wellhead. In some cases, a frangible barrier is installed at the toe of the casing and used to pressure up the casing string to test for leaks. Once the casing string is pressure tested, the barrier must be removed from the production string.

Several mechanisms and arrangements to remove the barrier are known in the prior art, such as Magnum's Magnumdisk™, the Halliburton mirage disappearing plug, and others.

It is desirable that after the barrier is removed, the full wellbore is restored, meaning that the inner diameter of the casing is not restricted. The barrier can be removed in a variety of ways. The most common removal method uses a pressure event that activates a shear or burst mechanism that allows the barrier to be pushed or pumped to the bottom of the wellbore. For horizontal wells, where barriers may not fall to the bottom of the wellbore, some barriers are made of a frangible material or degrading material that degrades into components small enough so they do not prevent flow or restrict the casing inner diameter after a certain time. These types of barriers, while effective, still leave some debris that requires additional specialized components to catch the debris so future completion of the well can be carried out. For example, when the Magnum's Magnumdisk™ is used, a catcher must be installed further down the casing string which catches the frangible disc material before cementing is completed, thus adding to the complexity, cost and reliability of the well system.

Prior art references of interest are U.S. Pat. Nos. 10,107,070; 7,513,311; 6,026,903; and US Publication Nos. 2018/0306027 and 2012/0168152 which disclose various prior art removable barriers and/or materials used to form and/or dissolve the one or more portions of the removable barriers, which disclosures are fully incorporated herein by reference.

In view of the problems associated with prior art temporary barriers for use in temporary wellbore isolation, there is a need for an improved barrier that minimizes the formation of debris after the barrier is removed or breached.

SUMMARY OF THE DISCLOSURE

The present disclosure pertains to an apparatus or device in the form of a temporary well isolation device. The temporary well isolation device generally includes an axial passage, a temporary barrier, and a cavity containing a chemical material, and wherein the temporary barrier can be actuated by an external mechanism to allow the chemical material to be exposed to a fluid. In particular, the temporary well isolation device generally includes a temporary barrier or plug member to control fluid flow to a self-contained cavity in the temporary well isolation device, which self-contained cavity includes a chemical material formulated to at least partially corrode, dissolve, and/or degrade the body of the temporary well isolation device. The temporary well isolation device is generally configured to hold a fluid pressure load while held in the tubing or casing until a trigger mechanism causes the partial or full fracturing, disintegration, dissolution, degradation, etc., of the temporary well isolation device. Such trigger mechanism includes, but is not limited to: a) an external pressure pulse or pulses applied to temporary barrier or plug member of the temporary well isolation device; b) exposure of the temporary barrier or plug member of the temporary well isolation device to an increase or decrease of temperature; c) exposure of the temporary barrier or plug member of the temporary well isolation device to changes in the composition, pH, and/or acidity of the wellbore/flowbore fluid to cause the temporary barrier or plug member of the temporary well isolation device to partially or fully disintegrate, dissolve, degrade, etc.; d) the use of a dissolvable or degradable component that partially or fully forms the temporary barrier or plug member of the temporary well isolation device, wherein the dissolvable or degradable component, is dissolvable, degradable, or is otherwise compromised by the wellbore/flowbore fluid; e) the use of an electrical pulse or pulses applied to the temporary barrier or plug member of the temporary well isolation device; f) temporary barrier or plug member in the form of a mechanical device that can be activated downhole or at the surface of the well; g) an explosive device applied to the temporary barrier or plug member of the temporary well isolation device to cause fracturing and/or disintegration of the temporary barrier or plug member; h) the temporary barrier is in the form of a coated component on the temporary well isolation device that slowly degrades, dissolves, or is otherwise compromised in presence of the wellbore/flowbore fluid; and/or i) a sonic or ultrasonic pulse applied to the temporary barrier or plug member of the temporary well isolation device.

In one non-limiting aspect of the disclosure, the temporary well isolation device can be made of a) an outer housing that is optionally tubular and which outer housing has an inner passage/cavity, b) a barrier body/inner housing that is configured to temporarily block fluid flow (e.g., wellbore/flowbore fluid) into the inner passage/cavity, and c) one or more chemical materials (e.g. salt, solid acid or other active chemical material) that are located in the inner passage/cavity of the barrier body, and wherein exposure of one or more chemical materials to the wellbore/flowbore fluid causes the one or more chemical materials to at least partially cause the barrier body/inner housing to mostly (e.g., at least 70%) or fully corrode, dissolve, and/or degrade, thereby removing the temporary barrier from the wellbore. As can be appreciated, the size, shape, and configuration of the temporary well isolation device is non-limiting. The wellbore/flowbore fluid can be fresh water, a salt water or brine mixture (e.g., brines [chlorides, bromides, and formats (salt of formic acid)), or any other fluid that is commonly used in well completion operations. The one or more chemical materials are generally used to a) accelerate the corrosion of the temporary barrier, and/or b) minimize the byproducts of corrosion of the components of the temporary well isolation device by partially or fully solubilizing one or more components of the temporary well isolation device and allowing pressure integrity until such a time when one or more chemical materials are exposed to the wellbore/flowbore fluid.

In another and/or alternative non-limiting aspect of the disclosure, there is provided an apparatus or device positioned by an operator in a subterranean well, which apparatus or device comprises a) an outer housing that is optionally tubular and has an inner flow passage, and b) a temporary well isolation device that is connected to the outer housing, and wherein the temporary well isolation device includes i) a temporary inner housing, ii) a temporary barrier or plug member that is partially or fully removable, dislodgable, degradable, dissolvable, disintegratable, etc., and wherein the temporary barrier or plug member is configured to block fluid flow into an inner flow passage and/or inner cavity, and iii) a chemical material that is positioned in the inner flow passage and/or inner cavity that is fluidly connected to the inner flow passage, and wherein the chemical material is formulated to partially or fully solubilize the inner housing, and optionally the temporary barrier or plug member when the chemical material is exposed to a fluid (e.g., wellbore/flowbore fluid) once the temporary barrier or plug member has been partially or fully removed, dislodged, degraded, dissolved, disintegrated, etc.

In another and/or alternative non-limiting aspect of the disclosure, the temporary barrier or plug member includes a body or structure made from a structural material that can be degraded or dissolved by the chemical material that is included in the apparatus or device.

In another and/or alternative non-limiting aspect of the disclosure, the body or structural material of the plug member is partially or fully made of magnesium alloy, zinc alloy, aluminum alloy, polymer, ceramic, or other degradable metal or material.

In another and/or alternative non-limiting aspect of the disclosure, the chemical material includes, but is not limited to, one or more acids, buffer compound, base, salt, and/or oxidizer. In one non-limiting embodiment, the chemical material is formulated to be activated by wellbore/flowbore fluid exposure. Non-limiting salts and acids include $NaHSO_4$, $AlCl_3$, $FeCl_3$, NaCl, KCl, $CaCl_2$, NaBr, $AlBr_3$, $BF_3$, $Na_2SO_4$, $AlF_3$, KI, NaI, $ZnCl_2$, $ZnBr_2$, $CuCl_3$, KBr, $MgCl_2$, acids of carboxylic acids (steric acid, benzoic acid, maleic acid, malonic acid, etc.), solid acids such as phosphoric acid, sulfates such as sodium sulfate, sulfur oxide, and acid chloride such as ethonyl chloride, benzoic chloride, and/or other metal salts. In one non-limiting arrangement, the chemical material is a solid material. The chemical material can be used to limit or prevent $Mg(OH)_2$ build-up and to maintain degradation rates of the degradable component if poor fluid circulation occurs about the degradable component. In another and/or alternative non-limiting aspect of the present disclosure, the one or more chemical material are a solid acid, such as $FeCl_3$, $AlCl_3$, or $Na_2SO_4$. In one non-limiting embodiment, the ratio of the solid acid to the degradable metal is selected to shift the degradation byproducts and/or solution pH away from insoluble hydroxides to soluble sulfates or chlorides or oxychlorides. In another and/or alternative non-limiting embodiment, there is provided a temporary well isolation device that includes a degradable material such as a magnesium alloy, zinc alloy, or aluminum alloy, or other degradable metal, and the byproduct of the dissolution or corrosion of the degradable material (e.g., magnesium hydroxide, aluminum hydroxide, zinc hydroxide, or other metal hydroxide) is more soluble in the water or aqueous solution because of the presence of the one or more chemical material (e.g., solid acid or other active chemical) in the water or fluid about the degradable component.

In another and/or alternative non-limiting aspect of the disclosure, the one or more chemical materials in the temporary well isolation device constitute about 0.1-30 wt. % of the temporary well isolation device (and all values and ranges therebetween), typically the one or more chemical materials constitute about 1-30 wt. % of the temporary well isolation device, and more typically the one or more chemical materials constitute about 3-10 wt. % of the temporary well isolation device.

In another and/or alternative non-limiting aspect of the disclosure, the one or more chemical materials in the temporary well isolation device are formulated to partially or fully neutralize the formation of hydroxides in the wellbore fluid that is located about the temporary well isolation device and/or to maintain a pH of the wellbore fluid below about 10. In one non-limiting specific configuration, the one or more chemical temporary well isolation device materials are formulated to maintain a pH of the wellbore fluid below about 8 that is located about the temporary well isolation device, typically a pH of the wellbore fluid below 7 that is located about the temporary well isolation device, and more typically a pH of the wellbore fluid below about 6 that is located about the temporary well isolation device.

In another and/or alternative non-limiting aspect of the present disclosure, the one or more chemical materials are added into the cavity of the temporary well isolation device while the one or more chemical materials are in a molten state. In one non-limiting embodiment, the one or more chemical materials are or include a molten salt or acid that is added into the cavity of the temporary well isolation device. In another non-limiting embodiment, the one or more chemical materials are heated to a molten state and then poured into a mold. In another non-limiting embodiment, the one or more chemical materials are melted in its hydrate or water-containing form, poured into a cavity of the temporary well isolation device, and wherein the one or more melted chemical materials are continued to be heated to remove 90-100% of the water from the one or more chemical materials so that the one or more chemical materials solidify in its anhydrous, or lower $H_2O$ content form. In another and/or alternative non-limiting embodiment, the one or more chemical materials are melted and poured into a cavity of the temporary well isolation device so that the temporary well isolation device does not react or dissolve while the one or more chemical materials are in molten state, and which the one or more chemical materials do not cause significant degradation to the properties of the temporary well isolation device (less than 10% degradation of the hardness and/or strength of the temporary well isolation device) over a period of at least 1 month (e.g., 1-12 months, 1-6 months, 1-3, months) while the temporary well isolation device is stored in a non-liquid and dry condition (less than 80 humidity) at ambient temperatures (e.g. 20-28° C.).

In another and/or alternative non-limiting aspect of the disclosure, the one or more chemical materials in the temporary well isolation device are formulated to produce about 1000-10000 ppm of chloride content (and all values and ranges therebetween) in the wellbore fluid located about the temporary well isolation device, and typically about 3000-5000 ppm chloride content in the wellbore fluid located about the temporary well isolation device.

In another and/or alternative non-limiting aspect of the present disclosure, the one or more chemical material can optionally be in the form of granules, pellets, powders, gel, or thin film. In one non-limiting embodiment, the one or more chemical material are in the form of a particle, which particle is a microparticle or a nanoparticle; however, this is not required. In another non-limiting embodiment, the one or more chemical material in the form of a plurality of particles are optionally compressed to form a solid pellet. The solid pellet can include one or more different types of chemical materials. Generally, the size of the pellet (when used) can pass through Mesh size No. 4 to No. 140 (and all sizes and size ranges therebetween).

In another and/or alternative non-limiting aspect of the present disclosure, the amount of the one or more chemical materials included on or in the temporary well isolation device is selected to ensure at least 35% solubilization (reaction) of the temporary well isolation device. As such, the amount of the one or more chemical materials included on or in the temporary well isolation device is at least 35% the stoichiometric amount of the chemical material required to cause at least 30-35% of the stoichiometric amount of the temporary well isolation device to solubilize or dissolve. In one non-limiting embodiment, the amount of the one or more chemical materials included on or in the temporary well isolation device is about 35-150% (and all values and ranges therebetween) the stoichiometric amount of the chemical material required to cause 30%-100% of the stoichiometric amount degradable material that partially or fully forms the temporary well isolation device to solubilize or dissolve. In another non-limiting embodiment, the amount of the one or more chemical material included on or in the temporary well isolation device is about 50-150% the stoichiometric amount of the chemical material required to cause 40-100% of the stoichiometric amount of the degradable material in the temporary well isolation device to solubilize or dissolve. In another non-limiting embodiment, the amount of the one or more chemical materials included on or in the temporary well isolation device is about 80-120% the stoichiometric amount of the chemical material required to cause 70-100% of the stoichiometric amount of the degradable material in the temporary well isolation device to solubilize or dissolve. Examples of stoichiometric amounts for chemical materials for magnesium are as follows:

A. 4.5 grams of $FeCl_3$ per gram of magnesium, or 2.76 cc of $FeCl_3$ per cc of magnesium ($MgOH+\frac{2}{3}FeCl_3+H_2O \rightarrow MgCl_2+Fe(OH)_3$).

B. 3.7 grams of $AlCl_3$ per gram of magnesium, or 1.35 cc of $AlCl_3$ per cc of magnesium.

C. 4.94 grams of $NaHSO_4$ per gram of magnesium, or 3.24 cc of $NaHSO_4$ per cc of magnesium.

In another and/or alternative non-limiting aspect of the present disclosure, the temporary well isolation device can include one or more chemical materials. When two or more chemical materials are used, 1) the concentration of the two or more chemical materials can be the same or different, 2) the location of the two or more chemical materials on/in the temporary well isolation device can be the same or different, 3) the time of release of the two or more chemical materials from the temporary well isolation device can be the same or different, and/or 4) the rate of release of the two or more chemical materials from the temporary well isolation device can be the same or different. The one or more chemical materials can optionally have controlled release properties by one or more mechanisms such as 1) a degradable or dissolvable coating about the outer surface of the chemical material, 2) the particle size of the chemical material, and/or 3) the shape of the particles of the chemical material. For example, concentrated amounts of the one or more chemical materials can be released over a short period after exposure to the targeted depth/distance in the well and/or exposure to certain pressures, temperatures, and/or chemical environment in the well.

In another and/or alternative non-limiting aspect of the disclosure, the partial or full removal of the temporary barrier or plug member of the temporary well isolation device can be triggered via a mechanism including, but not limited to: a) an external pressure pulse or pulses and/or ultrasonic pulse or pulses that are applied to the temporary barrier or plug member to cause the temporary barrier or plug member to move, disintegrate, dissolve, degrade, fracture, be expelled, etc.; b) an increase or decrease of temperature about the temporary barrier or plug member to cause the temporary barrier or plug member to move, disintegrate, dissolve, degrade, fracture, be expelled, etc.; c) the use of a dissolvable or degradable component that partially or fully forms the temporary barrier or plug member that is compromised by the wellbore/flowbore fluid so as to cause the temporary barrier or plug member to partially or fully disintegrate, dissolve, degrade, etc.; d) the use of a dissolvable or degradable component that partially or fully forms the temporary barrier or plug member that is compromised by changes in the composition, pH, and/or acidity of the wellbore/flowbore fluid so as to cause the temporary barrier or plug member to partially or fully disintegrate, dissolve, degrade, etc.; e) the use of an electrical pulse or pulses applied to the temporary barrier or plug member to cause the temporary barrier or plug member to move, disintegrate, dissolve, degrade, fracture, be expelled, etc.; f) a mechanical device (e.g., valve, flap, plug, movable door or plate, etc.) that partially or fully forms the temporary barrier or plug member, and wherein the mechanical device can be activated (e.g., caused to open, caused to move, caused to fracture, caused to be expelled, etc.) downhole or at some location on the surface (e.g., well surface, area about the well surface, etc.); g) an explosive device positioned on and/or near the temporary barrier or plug member, which explosion device causes the temporary barrier or plug member to move, fracture, disintegrate, be expelled, etc.; h) the temporary barrier or plug member is partially or fully coated with a coating material formulated to controllably degrade, dissolve, or otherwise become compromised in the presence of the wellbore/flowbore fluid, wherein the degrading, dissolving, and/or compromising of the coating material allows the wellbore/flowbore fluid to 1) flow through the temporary barrier or plug member and/or 2) contact other materials that form the temporary barrier or plug member to cause such other materials to disintegrate, dissolve, degrade, etc., when exposed to the wellbore/flowbore fluid, and wherein the rate of disintegration, dissolving, degrading, etc., of the other materials when exposed to the wellbore/flowbore fluid is generally greater than the rate of disintegration, dissolving, degrading, etc., of the coating material when exposed to the wellbore/flowbore fluid; i) a sonic or ultrasonic pulse applied to the temporary barrier or plug member to cause the temporary barrier or plug member to move, disintegrate, dissolve, degrade, fracture, be expelled, etc., and/or j) a puncturing or fracturing device (e.g., lance, pole, etc.) that is cause to be impacted on the temporary barrier or plug member to cause the temporary barrier or plug member to be pierced, fractured, moved, etc.

In another and/or alternative non-limiting aspect if the present disclosure, the temporary well isolation device can optionally include tracer element. The one or more tracer elements (e.g., tracer chemicals, chemical elements, particles, tags [RFID, microdevice, etc.], etc.) can be 1) coated on the temporary well isolation device, 2) incorporated in the composition of the temporary well isolation device, and/or 3) contained in one or more cavities of the temporary well isolation device. The one or more tracer elements released upon the partial or full dissolution of the temporary well isolation device can be configured to be detected at the surface of a well site or detected at some other location to determine the proper removal or degradation of the temporary well isolation device. Tracer elements can be released as ions/atoms, molecules, or particles species, or can be discreet devices such as RFID microchips, etc. The one or more tracer elements can be incorporated uniformly throughout the temporary well isolation device, added to specific locations on and/or in the temporary well isolation device, or placed at different depths within the temporary well isolation device. A temporary well isolation device can include a single tracer element or two or more different tracer elements. The tracer element can be 1) uniformly dispersed in the temporary well isolation device, 2) positioned in one or more regions of the temporary well isolation device, 3) coated on one or more portions of the outer surface or all of the outer surface of the temporary well isolation device, and/or 4) concentrated in one or more regions of the temporary well isolation device. The tracer element can be chosen from one or more tracer elements which can include microRFID, magnetic wires, nanowires, magnetic particles, fluorescing, and phosphorescent compounds and/or particles; and/or from compounds or molecules that can include stable isotopes, radioactive isotopes, rare earth or other specific elements, as well as compounds with high sensitivity in mass spectroscopy or other analytical techniques that are sensitive to ppb levels. A variety of detectable materials can be used as the tracer element such as trackers, taggants, markers, tracking materials, and/or tracers.

In another and/or alternative non-limiting aspect of the disclosure, the body of the apparatus or device can be designed to withhold a pressure or differential pressure (e.g., 500-50,000 psi and all values and ranges therebetween) enabling isolation or testing of the well string in the wellbore or other type of subterranean structure.

In another and/or alternative non-limiting aspect of the disclosure, there is provided a method of blocking fluid flow through a pipe, tool flow bore, wellbore, or subterranean structure using a triggerable temporary well isolation device, the method comprising depositing the temporary well isolation device within a wellbore or subterranean structure to inhibit or block fluid flow past the temporary well isolation device, and thereafter triggering the temporary well isolation device to cause the temporary well isolation device to partially or fully disintegrate, dissolve, degrade, fracture, etc., to permit fluid flow through the pipe, tool flow bore, wellbore, or subterranean structure.

In another and/or alternative non-limiting aspect of the disclosure, the activation/triggering step further comprises exposing at least a portion of a plug member on the triggerable temporary well isolation device to a pressurized fluid source, wherein that fluid source includes, but is not limited, to fresh water, brine solutions, and other aqueous solutions.

In another and/or alternative non-limiting aspect of the disclosure, the activation/triggering step causes a barrier (e.g., coating, plug member, degradable or dissolvable metal, polymer, and/or ceramic portion of the temporary well isolation device) to partially or fully disintegrate, dissolve, degrade, fracture, etc., to permit fluid (e.g., fresh water, brine solutions, other aqueous solutions, etc.) to contact a chemical material within the temporary well isolation device, which fluid exposure to the chemical material causes further degradation, dissolving, fracturing, etc., of the temporary well isolation device.

In another and/or alternative non-limiting aspect of the disclosure, when the chemical material within the temporary well isolation device is exposed to fluid (e.g., fresh water, brine solutions, other aqueous solutions, etc.), the chemical material causes sufficient degradation, dissolving, fracturing, etc., of the temporary well isolation device within one minute to 12 hours (and all values and ranges therebetween [1-60 min. (e.g., 30 min.), 0.8-4 hours (e.g., one hour), 3-8 hours (four hours), 7-12 hours (e.g., eight hours)] to 1) allow fluid to pass by and/or through the temporary well isolation device or 2) allow an increased flowrate of fluid 5-100+% (e.g., 5-500,000% increase and all values and ranges therebetween) past the temporary well isolation device.

In another and/or alternative non-limiting aspect of the disclosure, the temporary well isolation device includes a temporary housing having a shape, size, and/or configuration that is non-limiting. In one non-limiting embodiment, the temporary housing has a generally circular cross-sectional shape along the longitudinal axis of the temporary housing. In one non-limiting design, the temporary housing has 1) a generally circular cross-sectional shape along the longitudinal axis of the temporary housing, wherein the generally circular cross-sectional shape has a maximum diameter of 0.5-50 in. (and all values and ranges therebetween), and typically the generally circular cross-sectional shape has a maximum diameter of 2-40 in., 2) a maximum longitudinal length of 0.1-5 ft. (and all values and ranges therebetween), and typically a maximum longitudinal length of 0.2-1 ft., and 3) the temporary housing is formed of 60-100% degradable and/or dissolvable material (and all values and ranges therebetween), and typically the temporary housing is formed of 90-100% degradable and/or dissolvable material.

In another and/or alternative non-limiting aspect of the disclosure, the temporary well isolation device includes a temporary housing partially or fully formed of a degradable and/or dissolvable material. In another and/or alternative non-limiting design, the degradable and/or dissolvable material includes one or more metals of magnesium, magnesium alloy, zinc alloy, or aluminum alloy, or other degradable metal, and at least one of the byproduct of the dissolution and/or dissolving of the degradable material includes magnesium hydroxide, aluminum hydroxide, zinc hydroxide, and/or other metal hydroxide. When magnesium alloy is used to partially or fully form the temporary housing, the magnesium alloy generally contains at least 30 wt. % magnesium, typically greater than 50 wt. % magnesium, typically at least about 70 wt. % magnesium, and even more typically at least about 85 wt. % magnesium. The one or more metals that can be included in the magnesium alloy can include, but are not limited to, aluminum, calcium, lithium, manganese, rare earth metal, silicon, SiC, yttrium, zirconium, nickel, copper, cobalt, iron, boron, titanium, bismuth, and/or zinc. The magnesium alloy can optionally include fillers such as, but not limited to, microballoons (e.g., less than 1-5 mm in diameter) formed of glass, carbon or ceramic, microballs (e.g., less than 1-5 mm in diameter), carbon fibers, etc. When aluminum alloy is used to partially or fully form the temporary housing, the aluminum alloy generally contains at least 60 wt. % aluminum, typically at least 75 wt. % aluminum, and more typically at least 80 wt. % aluminum. The one or more metals that can be included in the aluminum alloy include bismuth, nickel, copper, cobalt, gallium, magnesium, indium, silicon, tin, iron, bismuth, titanium, and/or zinc. The aluminum alloy can optionally include fillers such as, but not limited to, microballoons (e.g., less than 1-5 mm in diameter) formed of glass, carbon, or ceramic, microballs (e.g., less than 1-5 mm in diameter), carbon fibers, etc. Other dissolvable and/or degradable metals that can be used to partially or fully form the temporary housing can include calcium alloys (e.g., Ca—Mg, Ca—Al; and Ca—Zn); and zinc alloys (e.g., Zn—Mg alloys, Zn—Mg—Fe alloys, Zn—Mg—Sr alloys, Zn—Al—Cu alloys, Zn—Al—Mg—Bi alloys, etc.). When one or more polymers are used to partially or fully form the temporary housing, the one or more degradable plastic or polymer materials can include polyacetals, polysulfones, polyurea, epoxies, silanes, carbosilanes, silicone, polyarylate, polyacrylates, and polyimide. The polymer material can optionally include one or more strengthening and/or diluting fillers such as fumed silica, silica, glass fibers, carbon fibers, carbon nanotubes, and other finely divided inorganic material.

In another and/or alternative non-limiting aspect of the disclosure, the temporary well isolation device includes a temporary housing having one or more internal cavities. The size, shape, and/or configuration of the one or more internal cavities is non-limiting. In one non-limiting design, the one or more internal cavities constitute 20-95 vol. % of the temporary housing (and all values and ranges therebetween), typically the one or more cavities constitute 25-90 vol. % of the temporary housing, more typically the one or more internal cavities constitute 55-90 vol. % of the temporary housing, and even more typically the one or more internal cavities constitute 60-85 vol. % of the temporary housing. In another and/or alternatively non-limiting design, the temporary housing includes only a single internal cavity. In another and/or alternative non-limiting design, the average wall thickness of one or more walls of the one or more internal cavities is 0.05-2 in. (and all values and ranges therebetween), and typically the average wall thickness of one or more walls of the one or more internal cavities is 0.1-1.5 in. In another and/or alternative non-limiting design, the average wall thickness of at least one of the walls of the one or more internal cavities is thinner than the average thickness of one or more other walls of the one or more internal cavities.

In another and/or alternative non-limiting aspect of the disclosure, the temporary well isolation device includes a temporary housing having one or more internal cavities wherein the temporary housing can be exposed to external pressures of 500-500,000 psi (and all values and ranges therebetween) without causing any damage to the one or more internal cavities, and/or without causing more than 5% volume reduction of the internal cavity and/or less than 5% wall bending of the walls of the internal cavity, typically the temporary housing can be exposed to external pressures of 1000-250,000 psi without causing any damage to the one or more internal cavities, and/or without causing more than 5% volume reduction of the internal cavity and/or less than 5% wall bending of the walk of the internal cavity, and more typically the temporary housing can be exposed to external pressures of 2000-100,000 psi without causing any damage to the one or more internal cavities, and/or without causing more than 5% volume reduction of the internal cavity and/or less than 5% wall bending of the walls of the internal cavity.

In another and/or alternative non-limiting aspect of the disclosure, the temporary well isolation device includes a temporary housing having one or more temporary barriers or plug members located on one or more exterior walls of the temporary housing, and wherein the one or more temporary barriers or plug members are configured to inhibit or prevent fluid from flowing into one or more internal cavities in the temporary housing until the one or more temporary barriers or plug members are 1) partially or fully opened, 2) partially or fully expelled from the temporary housing, 3) partially or fully caused to be dislodged (e.g., sheared and/or pushed partially or fully into one or more internal cavities, sheared and/or pushed partially or fully into one or more internal passageways, etc.) by applying elevated external pressures to the one or more temporary barriers or plug members, 4) partially or fully pierced and/or fractured by an external device or tool, and/or 5) partially or fully dissolved, degraded, disintegrated, and/or fractured. In one non-limiting design, one or more of the temporary barriers or plug members are a) positioned partially or fully over an internal passageway, which internal passageway provides fluid access between the exterior of the temporary housing and one or more internal cavities, and/or b) positioned partially or fully in an internal passageway, which internal passageway provides fluid access between the exterior of the temporary housing and one or more internal cavities. In another non-limiting design, at least one of the temporary barrier or plug members is i) a single part formed of a uniform composition, ii) a single part formed of two or more different compositions, iii) a multi-part system formed of a uniform composition, or iv) a multi-part system formed of two of more different compositions. In another non-limiting design, at least one of the temporary barriers or plug members is partially or fully formed of a different material from the material used to form the temporary housing. In one particular non-limiting configuration, the one or more temporary barriers or plug members are configured to be partially or fully dislodged from its location on the temporary housing by applying an elevated pressure (e.g., a pressure pulse down, increase in fluid pressure, ultrasonic pulses, etc.) to the exterior of the temporary housing that includes the one or more temporary barriers or plug members. Such elevated pressure is selected such that the mechanism (e.g., one or more pins, compression or friction fit, threaded connection, etc.) maintaining the one or more temporary barriers' or plug members' position on the temporary housing partially or fully fails (e.g., one or more pins are caused to partially or fully bend and/or shear, the threaded connection is caused to partially or fully bend and/or shear the pressure on the temporary barrier or plug member is causes the compression or friction fit to fail thereby allowing the temporary barrier or plug to move relative to the temporary housing). In another particular non-limiting configuration, the one or more temporary barriers or plug members are configured to be partially or fully fractured, pierced, and/or disintegrated by use of 1) a piercing lance to pierce the temporary barrier or plug member, or 2) the activation of an explosive charge to damage the temporary barrier or plug member. In another particular non-limiting configuration, the one or more temporary barriers or plug members are configured to partially or fully dissolve and/or degrade by exposure of the exterior surface of the one or more temporary barriers or plug members to 1) a pH change in the wellbore/flowbore fluid about the temporary barrier or plug member, 2) a change in temperature in the wellbore/flowbore fluid about the temporary barrier or plug member, and/or 3) a change in the chemical composition of the wellbore/flowbore fluid about the temporary barrier or plug member. In another particular non-limiting configuration, the one or more temporary barriers or plug members include a coating, which coating is configured to partially or fully dissolve and/or degrade by exposure of the exterior surface of the one or more temporary barriers or plug members to 1) a pH change in the wellbore/flowbore fluid about the temporary barrier or plug member, 2) a change in temperature in the wellbore/flowbore fluid about the temporary barrier or plug member, and/or 3) a change in the chemical composition of the wellbore/flowbore fluid about the temporary barrier or plug member. Once the coating has been partially or fully dissolved and/or degraded, then a) fluid can flow thought one or more openings in the temporary barrier or plug member that was formally covered by the coating, and/or b) the material of the temporary barriers or plug member is exposed to the wellbore/flowbore fluid which results in accelerated degradation and/or dissolving of the temporary barriers or plug member.

In another and/or alternative non-limiting aspect of the disclosure, the temporary well isolation device includes a temporary housing having one or more temporary barriers or plug members located on one or more exterior walls of the temporary housing, and wherein the one or more temporary barriers or plug members form about 2-90% (and all values and ranges therebetween) of an outer surface of one of the exterior walls of the temporary housing, typically the one or more temporary barriers or plug members form about 10-70% of an outer surface of one of the exterior walls of the temporary housing, and more typically the one or more temporary barriers or plug members form about 20-60% of an outer surface of one of the exterior walls of the temporary housing. The size, shape, and configuration of the one or more temporary barriers or plug members is non-limiting. In one non-limiting configuration, the one or more temporary barriers or plug members have a thickness of 0.01-2 in. (and all values and ranges therebetween), a length of 0.2-25 in. (and all values and ranges therebetween), and a width of 0.2-25 in. (and all values and ranges therebetween).

In another and/or alternative non-limiting aspect of the disclosure, the temporary well isolation device includes a temporary housing having one or more temporary barriers or plug members wherein the composition of the one or more temporary barriers or plug members is different from the composition of the temporary housing temporary housing; however, this is not required. When the one or more temporary barriers or plug members is partially or fully formed of a degradable and/or dissolvable material, such degradable and/or dissolvable material includes one or more metals of magnesium, magnesium alloy, zinc alloy, or aluminum alloy, or other degradable metal, and at least one of the byproducts of the dissolution and/or dissolving of the degradable material includes magnesium hydroxide, aluminum hydroxide, zinc hydroxide, and/or other metal hydroxide. When magnesium alloy is used to partially or fully form the temporary housing, the magnesium alloy generally contains at least 30 wt. % magnesium, typically greater than 50 wt. % magnesium, typically at least about 70 wt. % magnesium, and even more typically at least about 85 wt. % magnesium. The one or more metals that can be included in the magnesium alloy include, but are not limited to, aluminum, calcium, lithium, manganese, rare earth metal, silicon, SiC, yttrium, zirconium, nickel, copper, cobalt, iron, boron, titanium, bismuth, and/or zinc. The magnesium alloy can optionally include fillers such as, but not limited to, microballoons (e.g., less than 1-5 mm in diameter) formed of glass, carbon, or ceramic, microballs (e.g., less than 1-5 mm in diameter), carbon fibers, etc. When aluminum alloy is used to partially or fully form the temporary housing, the aluminum alloy generally contains at least 60 wt. % aluminum, typically at least 75 wt. % aluminum, and more typically at least 80 wt. % aluminum. The one or more metals that can be included in the aluminum alloy include bismuth, nickel, copper, cobalt, gallium, magnesium, indium, silicon, tin, iron, bismuth, titanium, and/or zinc. The aluminum alloy can optionally include fillers such as, but not limited to, microballoons (e.g., less than 1-5 mm in diameter) formed of glass, carbon, or ceramic, microballs (e.g., less than 1-5 mm in diameter), carbon fibers, etc. Other dissolvable and/or degradable metals that can be used to partially or fully form the temporary housing include calcium alloys (e.g., Ca—Mg, Ca—Al; and Ca—Zn); and zinc alloys (e.g., Zn—Mg alloys, Zn—Mg—Fe alloys, Zn—Mg—Sr alloys, Zn—Al—Cu alloys, Zn—Al—Mg—Bi alloys, etc.). When one or more polymers are used to partially or fully form the temporary housing, the one or more degradable plastic or polymer materials can include polyacetals, polysulfones, polyurea, epoxies, silanes, carbosilanes, silicone, polyarylate, polyacrylates, and polyimide. The polymer material can optionally include one or more strengthening and/or diluting fillers such as fumed silica, silica, glass fibers, carbon fibers, carbon nanotubes, and other finely divided inorganic material. In another and/or alternative non-limiting design, the degradable and/or dissolvable material includes one or more metals of magnesium, magnesium alloy, zinc alloy, or aluminum alloy, or other degradable metal, and at least one of the byproducts of the dissolution and/or dissolving of the degradable material includes magnesium hydroxide, aluminum hydroxide, zinc hydroxide, and/or other metal hydroxide. When magnesium alloy is used to partially or fully form the temporary housing, the magnesium alloy generally contains at least 30 wt. % magnesium, typically greater than 50 wt. % magnesium, typically at least about 70 wt. % magnesium, and even more typically at least about 85 wt. % magnesium. The one or more metals that can be included in the magnesium alloy can include, but are not limited to, aluminum, calcium, lithium, manganese, rare earth metal, silicon, SiC, yttrium, zirconium, nickel, copper, cobalt, iron, boron, titanium, bismuth, and/or zinc. The magnesium alloy can optionally include fillers such as, but not limited to, microballoons (e.g., less than 1-5 mm in diameter) formed of glass, carbon, or ceramic, microballs (e.g., less than 1-5 mm in diameter), carbon fibers, etc. When aluminum alloy is used to partially or fully form the temporary housing, the aluminum alloy generally contains at least 60 wt. % aluminum, typically at least 75 wt. % aluminum, and more typically at least 80 wt. % aluminum. The one or more metals that can be included in the aluminum alloy include bismuth, nickel, copper, cobalt, gallium, magnesium, indium, silicon, tin, iron, bismuth, titanium, and/or zinc. The aluminum alloy can optionally include fillers such as, but not limited to, microballoons (e.g., less than 1-5 mm in diameter) formed of glass, carbon, or ceramic, microballs (e.g., less than 1-5 mm in diameter), carbon fibers, etc. Other dissolvable and/or degradable metals that can be used to partially or fully form the temporary housing include calcium alloys (e.g., Ca—Mg, Ca—Al; and Ca—Zn) and zinc alloys (e.g., Zn—Mg alloys, Zn—Mg—Fe alloys, Zn—Mg—Sr alloys, Zn—Al—Cu alloys, Zn—

Al—Mg—Bi alloys, etc.). When one or more polymers are used to partially or fully form the temporary housing, the one or more degradable plastic or polymer materials can include polyacetals, polysulfones, polyurea, epoxies, silanes, carbosilanes, silicone, polyarylate, polyacrylates, and polyimide. The polymer material can optionally include one or more strengthening and/or diluting fillers such as fumed silica, silica, glass fibers, carbon fibers, carbon nanotubes, and other finely divided inorganic material.

In another and/or alternative non-limiting aspect of the disclosure, the temporary well isolation device includes a temporary housing having one or more temporary barriers or plug members wherein the one or more temporary barriers or plug members can be partially formed of a chemical material to accelerate the degradation, dissolving, and/or dissolution of the one or more temporary barriers or plug members; however, this is not required. The composition of the chemical material (when used) can be the same or different from the composition of the chemical material located in the one or more internal cavities of the temporary housing. The chemical material (when used) includes, but is not limited to, one or more acids, buffer compound, base, salt, and/or oxidizer. Non-limiting salts and acids include $NaHSO_4$, $AlCl_3$, $FeCl_3$, NaCl, KCl, $CaCl_2$, NaBr, $AlBr_3$, $BF_3$, $Na_2SO_4$, $AlF_3$, KI, NaI, $ZnCl_2$, $ZnBr_2$, $CuCl_3$, KBr, $MgCl_2$, acids of carboxylic acids (steric acid, benzoic acid, maleic acid, malonic acid, etc.), solid acids such as phosphoric acid, sulfates such as sodium sulfate, sulfur oxide, and acid chloride such as ethonyl chloride, benzoic chloride, and/or other metal salts.

In another and/or alternative non-limiting aspect of the disclosure, the temporary well isolation device includes a temporary housing having one or more internal cavities that contain a chemical material to 1) accelerate the degradation, dissolving, and/or dissolution of the temporary housing, 2) ensure 80-100% (and all values and ranges therebetween) degradation, dissolving and/or dissolution of the temporary housing, and/or 3) reduce or eliminate the byproducts of the degradation, dissolving, and/or dissolution of the temporary housing (e.g., magnesium hydroxide, aluminum hydroxide, zinc hydroxide, and/or other metal hydroxide, etc.). One or more of the internal cavities is 50-100% filled (and all values and ranges therebetween) with the chemical material, typically the one or more of the internal cavities is 60-100% filled with the chemical material. In one non-limiting configuration, the one or more of the internal cavities is 60-95% filled with the chemical material. Not fully filling the one or more internal cavities with chemical material enables the wellbore/flowbore fluid to enter the internal cavity and have a faster reaction with the chemical material to reduce the time of degradation, dissolving, and/or dissolution of the temporary housing.

In another and/or alternative non-limiting aspect of the disclosure, the temporary well isolation device includes three primary components, namely 1) a temporary housing including a cavity and an opening into the cavity, 2) a lid portion configured to cover and seal the opening in the cavity and also configured to be secured to the temporary housing, and 3) a chemical material located in the cavity. The lid portion and the temporary housing can be formed of the same or different material. The arrangement used to connect the lid portion to the temporary housing is non-limiting (e.g., threaded connection; compression fit and/or friction connection; connection by use of pins, screws, bolts, latches, etc.; weld or solder connection; adhesive connection; slot and groove connection; a slot and turn locking connection, expandable connection; paired shape connection arrangement, etc.). A dissolvable sealing ring can be optionally used to facilitate in forming a fluid seal between the lip portion and the temporary housing. The temporary housing generally has a cylindrical shape; however, this is not required. The lid can optionally include a thicker outer rim portion and a thinner central portion that is encircled by the outer rim portion. The thinner central portion can be configured to shear from the outer rim portion when a sufficient high pressure is applied to the surface of the thinner central portion. The lid can be formed of a single piece of material or be formed of multiple pieces. When the lid is formed of a single piece, the single-piece lid can be formed by molding process, a casting process, a stamping process, a machining process, etc. When the lid is formed of multiple pieces, non-limiting components include, but are not limited to, an outer rim portion and a central portion located within the inner perimeter of the outer rim portion and which central portion is connected to the outer rim portion by a connection arrangement (e.g., threaded connection; compression fit and/or friction connection; connection by use of pins, screws, bolts, latches, etc.; weld or solder connection; adhesive connection; slot and groove connection; a slot and turn locking connection, expandable connection; paired shape connection arrangement, etc.).

In another and/or alternative non-limiting aspect of the disclosure, the temporary well isolation device includes an outer housing and a temporary housing, wherein the temporary housing is secured to the outer housing by a connection arrangement (e.g., threaded connection arrangement, friction connection arrangement, slot and groove connection arrangement, paired shape connection arrangement [e.g., trapezoidal shaped temporary housing fitted into a circular or funnel shaped opening in the outer housing], etc.). Generally, the outer housing is formed of a different material from the temporary housing. Generally, the outer housing is formed of a material that is less susceptible to degradation, dissolving, and/or dissolution as compared to the temporary housing when the wellbore/flowbore fluid contacts the chemical material in the temporary housing and causes the temporary housing to degrade, dissolve, and/or fracture. In one nonlimiting arrangement, the outer housing is formed of a material that only degrades and/or dissolves less than 10% during the time period that the temporary housing degrades and/or dissolves at least 50% due to the contact of the wellbore/flowbore fluid with the chemical material in the temporary housing, typically the outer housing is formed of a material that only degrades and/or dissolves less than 5% during the time period that the temporary housing degrades and/or dissolves at least 50% due to the contact of the wellbore/flowbore fluid with the chemical material in the temporary housing, more typically the outer housing is formed of a material that only degrades and/or dissolves less than 10% during the time period that the temporary housing degrades and/or dissolves at least 75% due to the contact of the wellbore/flowbore fluid with the chemical material in the temporary housing, even more typically the outer housing is formed of a material that only degrades and/or dissolves less than 5% during the time period that the temporary housing degrades and/or dissolves at least 75% due to the contact of the wellbore/flowbore fluid with the chemical material in the temporary housing, still more typically the outer housing is formed of a material that only degrades and/or dissolves less than 10% during the time period that the temporary housing degrades and/or dissolves at least 90% due to the contact of the wellbore/flowbore fluid with the chemical material in the temporary housing, and still even more typically the outer housing is formed of a material that only degrades and/or dissolves less than 5% during the time period that the temporary housing degrades and/or dissolves at least 90% due to the contact of the wellbore/flowbore fluid with the chemical material in the temporary housing.

In another and/or alternative non-limiting aspect of the disclosure, there is provided a method for temporarily blocking fluid flow through a pipe or tool flow, bore comprising the steps of: 1) providing a temporary well isolation device wherein the temporary well isolation device includes an outer housing and a temporary housing, wherein the temporary housing includes an internal cavity that contains a chemical material and a temporary barrier or plug member that seals the cavity from wellbore/flowbore fluid; 2) inserting the temporary well isolation device into a wellbore, a subterranean structure, or a pipe located in the wellbore or subterranean structure so as to partially or fully terminate the flow of wellbore/flowbore fluid past the location of the temporary well isolation device; 3) again allowing the flow of wellbore/flowbore fluid past the location of the temporary well isolation device by causing the temporary barrier or plug member to be partially or fully dissolved, degraded, fractured, and/or expelled or dislocated from its location to allow wellbore/flowbore fluid to enter the internal cavity and contact the chemical material in the cavity, thereby causing the temporary housing to dissolve, degrade, and/or fracture to ultimately cause the temporary housing to separate from the outer housing and allow the wellbore/flowbore fluid to freely flow past the outer housing. The step of inserting the temporary well isolation device into a wellbore, a subterranean structure, or a pipe located in the wellbore or subterranean structure can be by i) attaching the temporary well isolation device to a pipe and then inserting the pipe and temporary well isolation device into the wellbore or subterranean structure, or ii) inserting the temporary well isolation device into an existing pipe located in the wellbore or subterranean structure and connecting the outer housing of the temporary well isolation device to the existing pipe. The step of causing the temporary barrier or plug member to be partially or fully dissolved, degraded, fractured, and/or expelled or dislocated from its location can include i) mechanically causing the temporary barrier or plug member to move to an open position, ii) using a motor or other device to cause the temporary barrier or plug member to move to an open position, iii) partially or fully causing the temporary barrier or plug member to be dislodged (e.g., sheared and/or pushed partially or fully into one or more internal cavities, sheared and/or pushed partially or fully into one or more internal passageways, etc.) by applying elevated external pressures and/or ultrasonic pulses to the one or more temporary barriers or plug members; 4) partially or fully piercing and/or fracturing the temporary barrier or plug member by an external device or tool; 5) using an explosive device to partially or fully fracture or disintegrate the one or more temporary barriers or plug members; and/or 6) partially or fully dissolving, degrading, disintegrating, and/or fracturing the one or more temporary barriers or plug members.

These and other advantages of the present disclosure will become more apparent to those skilled in the art from a review of the description of the preferred embodiment and claims.

BRIEF DESCRIPTION OF THE DRAWINGS

Reference may now be made to the drawings, which illustrate various embodiments that the disclosure may take in physical form and in certain parts and arrangements of parts wherein.

DETAILED DESCRIPTION OF DISCLOSURE

Figure 1:
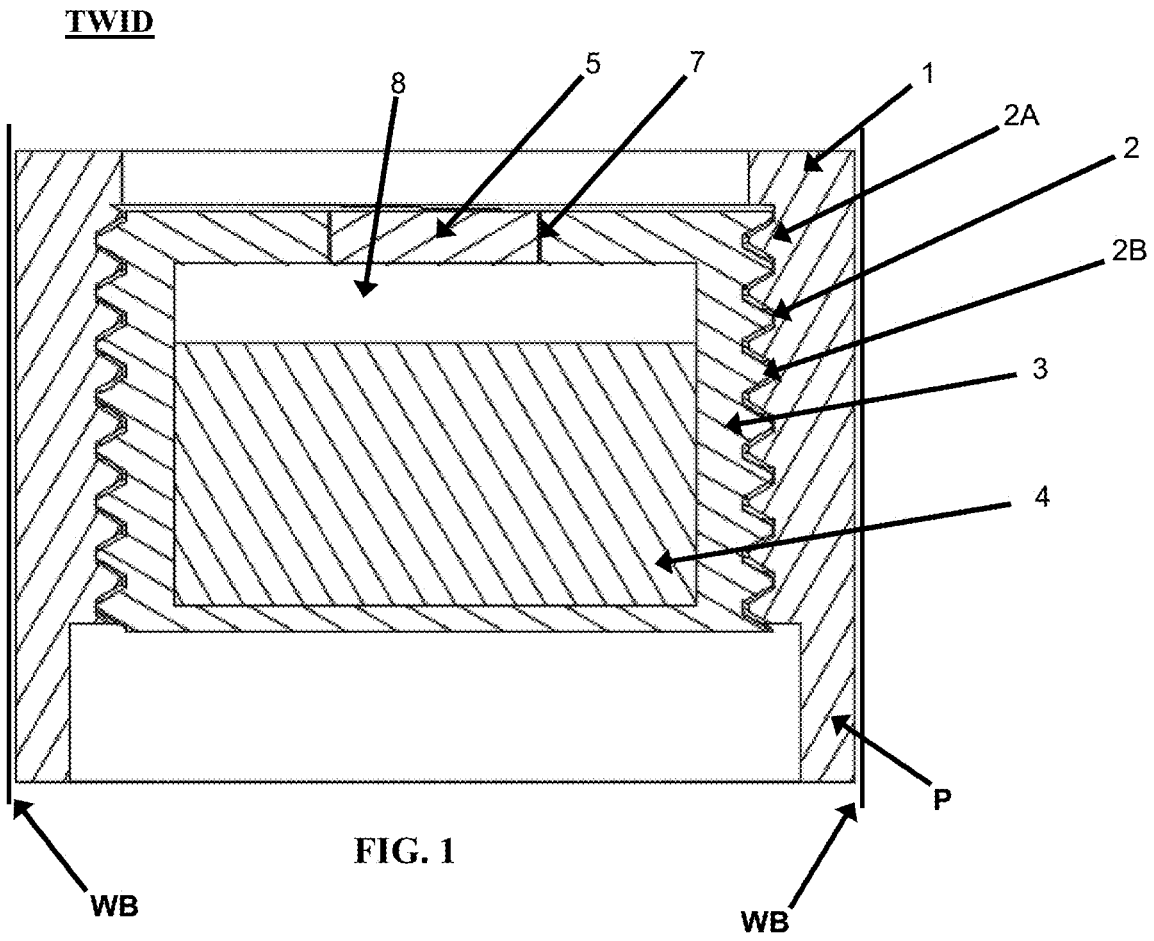
FIG. 1 illustrates a temporary well isolation device used in temporary wellbore isolation in accordance with the present disclosure.

A more complete understanding of the articles/devices, processes and components disclosed herein can be obtained by reference to the accompanying drawings. These figures are merely schematic representations based on convenience and the ease of demonstrating the present disclosure, and are, therefore, not intended to indicate relative size and dimensions of the devices or components thereof and/or to define or limit the scope of the exemplary embodiments.

Although specific terms are used in the following description for the sake of clarity, these terms are intended to refer only to the particular structure of the embodiments selected for illustration in the drawings and are not intended to define or limit the scope of the present disclosure. In the drawings and the following description below, it is to be understood that like numeric designations refer to components of like function.

The singular forms "a," "an," and "the" include plural referents unless the context clearly dictates otherwise.

As used in the specification and in the claims, the term "comprising" may include the embodiments "consisting of" and "consisting essentially of." The terms "comprise(s)," "include(s)," "having," "has," "can," "contain(s)," and variants thereof, as used herein, are intended to be open-ended transitional phrases, terms, or words that require the presence of the named ingredients/steps and permit the presence of other ingredients/steps. However, such description should be construed as also describing compositions or processes as "consisting of" and "consisting essentially of" the enumerated ingredients/steps, which allows the presence of only the named ingredients/steps, along with any unavoidable impurities that might result therefrom, and excludes other ingredients/steps.

Numerical values in the specification and claims of this application should be understood to include numerical values which are the same when reduced to the same number of significant figures and numerical values which differ from the stated value by less than the experimental error of conventional measurement technique of the type described in the present application to determine the value.

All ranges disclosed herein are inclusive of the recited endpoint and independently combinable (for example, the range of "from 2 grams to 10 grams" is inclusive of the endpoints, 2 grams and 10 grams, and all the intermediate values).

The terms "about" and "approximately" can be used to include any numerical value that can vary without changing the basic function of that value. When used with a range, "about" and "approximately" also disclose the range defined by the absolute values of the two endpoints, e.g. "about 2 to about 4" also discloses the range "from 2 to 4." Generally, the terms "about" and "approximately" may refer to plus or minus 10% of the indicated number.

Percentages of elements should be assumed to be percent by weight of the stated element, unless expressly stated otherwise.

DETAILED DESCRIPTION OF THE DISCLOSURE

Referring now to FIGS. 1-4, there is illustrated a non-limiting temporary well isolation device TWID that can be used in a temporary wellbore isolation application. The temporary well isolation device TWID includes a temporary housing 3 that is temporarily and/or releasably connected to an outer housing 1 by a connection arrangement 2. The outer housing 1 can be a component of the tubing P (e.g., work string tubing, drill pipe, wellbore pipe, etc.), or can optionally be a component of the TWID that is configured to be connected to, seated on, etc. the tubing P in the well.

The connection arrangement 2 is illustrated as threading 2A and 2B on the outer housing 1 and temporary housing 3, respectively. As can be appreciated, the connection arrangement 2 can be other types of arrangements (e.g., adhesive connection, pin connection, friction connection, compression connection, slot and groove connection, expandable connection, paired shape connection arrangement, rim and seat connection, etc.).

The temporary housing 3 includes an internal cavity 8 that includes a chemical material 4. The chemical material 4 is illustrated as only partially filling the internal cavity 8; however, this is not required. The chemical material 4 is selected to cause accelerated dissolving, degradation, dissolution, etc., of the temporary housing when the chemical material 4 is exposed to wellbore/flowbore fluid. The chemical material 4 can include one or more different chemical compounds.

The temporary housing 3 also includes an internal passageway 7 that is temporarily closed or sealed by a temporary barrier or plug member 5. The temporary barrier or plug member 5 is configured to allow fluid to flow through the internal passageway 7 and contact the chemical material 4 in the internal cavity 8 when the temporary barrier or plug member 5 is partially or fully opened, dislodged, disintegrated, fractured, dissolved, degraded, etc., by a trigger arrangement/mechanism. Such trigger arrangement/mechanism can include: a) mechanically causing the temporary barrier or plug member 5 to move to an open position; b) using a motor or other device to cause the temporary barrier or plug member 5 to move to an open position; c) applying an external pressure pulse or pulses to the temporary barrier or plug member 5 to cause the temporary barrier or plug member 5 to move, disintegrate, dissolve, degrade, fracture, be expelled, etc.; d) increasing or decreasing the temperature about the temporary barrier or plug member 5 to cause the temporary barrier or plug member 5 to move, disintegrate, dissolve, degrade, fracture, be expelled, etc.; e) using a dissolvable or degradable component that partially or fully forms the temporary barrier or plug member 5 which dissolvable or degradable component is compromised by the wellbore/flowbore fluid to cause the temporary barrier or plug member 5 to partially or fully disintegrate, dissolve, degrade, etc.; f) using a dissolvable or degradable component that partially or fully forms the temporary barrier or plug member 5 which dissolvable or degradable component that is compromised by changes in the composition, pH, and/or acidity of the wellbore/flowbore fluid so as to cause the temporary barrier or plug member 5 to partially or fully disintegrate, dissolve, degrade, etc.; g) using of an electrical pulse or pulses that are applied to the temporary barrier or plug member 5 to cause the temporary barrier or plug member 5 to move, disintegrate, dissolve, degrade, fracture, be expelled, etc.; h) including a mechanical device (e.g., valve, flap, plug, movable door or plate, etc.) in the temporary barrier or plug member 5 which mechanical device can be activated (e.g., caused to open, caused to move, caused to fracture, caused to be expelled, etc.) downhole or at some location on the surface (e.g., well surface, area about the well surface, etc.) to cause the temporary barrier or plug member 5 to open; i) using an explosive device that is positioned on and/or near the temporary barrier or plug member 5, which explosion device can be used to cause the temporary barrier or plug member 5 to move, fracture, disintegrate, be expelled, etc.; j) providing a temporary barrier or plug member 5 that is partially or fully coated with a coating material that is formulated to controllably degrade, dissolve, or otherwise become compromised in the presence of the wellbore/flowbore fluid, wherein the degrading, dissolving, and/or compromising of the coating material allows the wellbore/flowbore fluid to I) flow through the temporary barrier or plug member 5 and/or II) contact other materials that form the temporary barrier or plug member 5 to cause such other materials to disintegrate, dissolve, degrade, etc., when exposed to the wellbore/flowbore fluid; and/or k) applying an ultrasonic pulse or pulses to the temporary barrier or plug member 5 to cause the temporary barrier or plug member 5 to move, disintegrate, dissolve, degrade, fracture, be expelled, etc.

Figure 2:
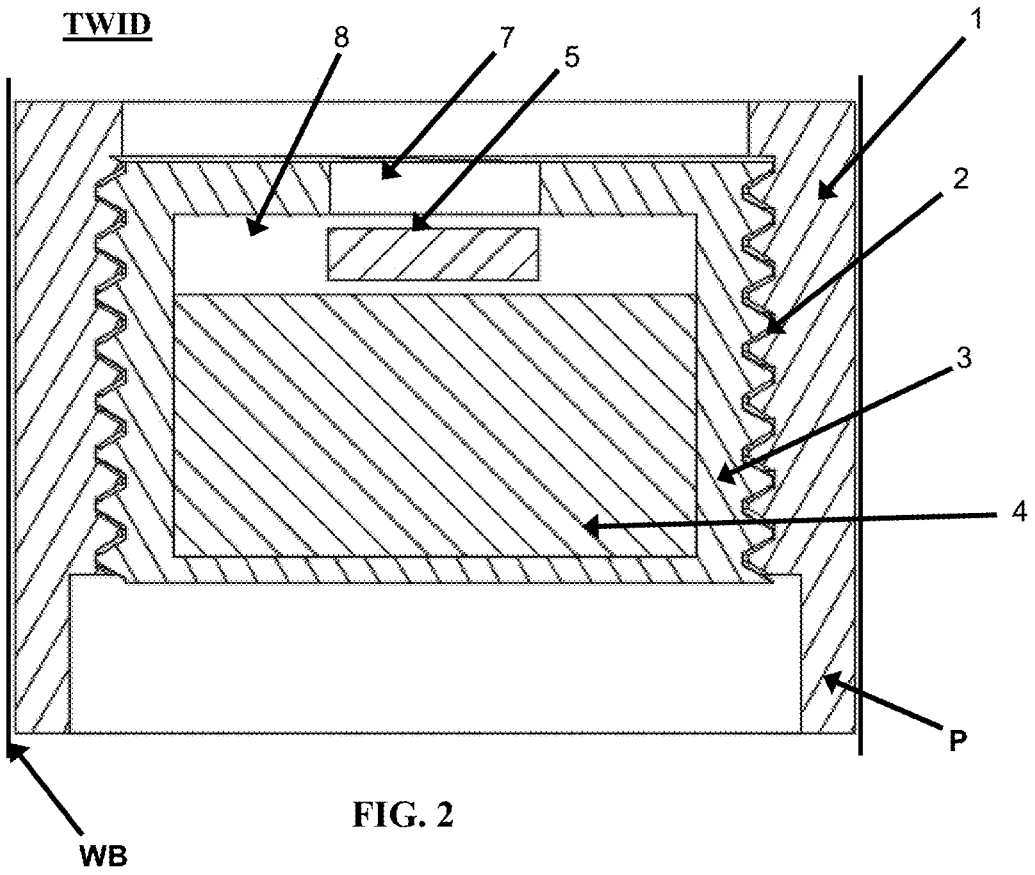
FIG. 2 illustrates the temporary well isolation device immediately after the trigger arrangement/mechanism has been activated, thereby allowing wellbore/flowbore fluid to enter a cavity in the temporary well isolation device and allowing the wellbore/flowbore fluid to contact chemical material in the cavity.
Figure 3:
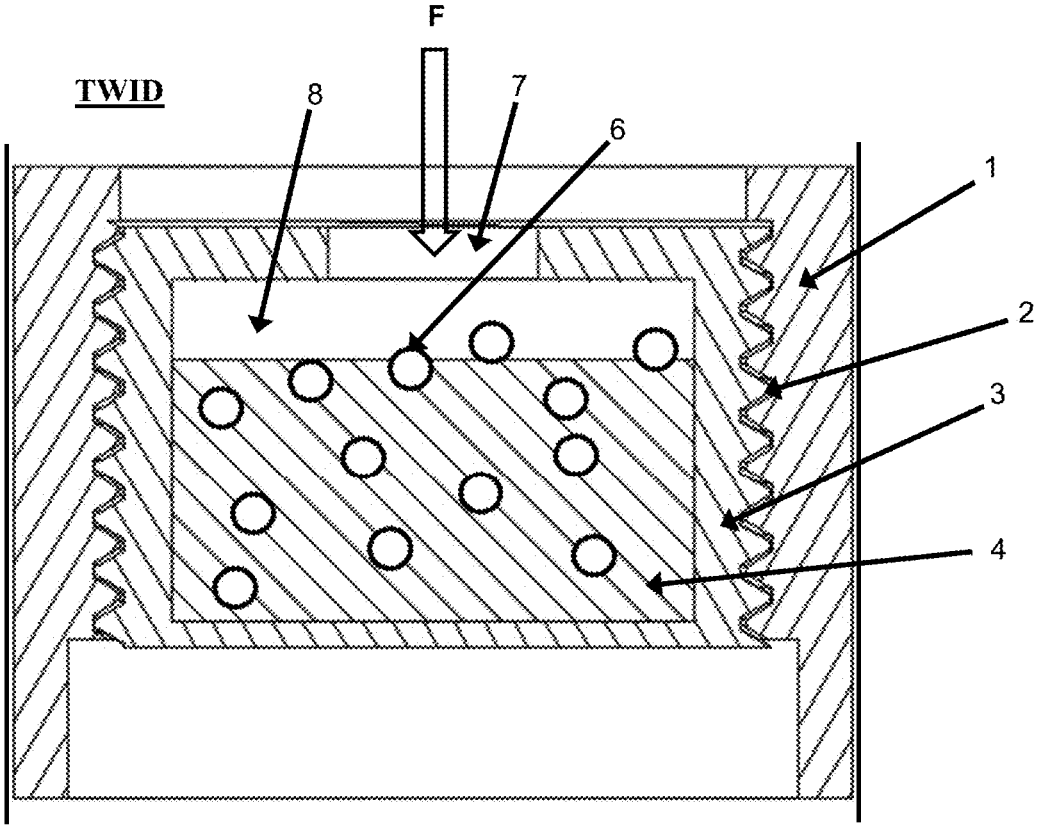
FIG. 3 illustrates the reaction of the wellbore/flowbore fluid and the chemical material in the cavity of the temporary well isolation device.

As illustrated in FIGS. 1-3, the outer housing 1 is positioned within a wellbore WB and is formed on an inner portion of pipe P. The outer housing 1 is generally connected to the wellbore WB or pipe P by a connection arrangement to remain in position relative to the wellbore WB or pipe P. The connection arrangement can include, but is not limited to, a cement connection, weld connection, solder connection, adhesive connection, pin connection, bolt and/or screw connection, friction connection, compression connection, slot and groove connection, expandable connection, and paired shape connection arrangement.

As illustrated in FIG. 1, the temporary barrier or plug member 5 is fitted in the top wall of the temporary housing 3 such that fluid (e.g., air, wellbore/flowbore fluid) cannot enter the internal cavity 8 via internal passageway 7.

FIG. 2 illustrates the temporary barrier or plug member 5 being dislodged from its position after a trigger arrangement/mechanism has caused the dislodgement of the temporary barrier or plug member 5. The dislodgement of the temporary barrier or plug member 5 allows the wellbore/flowbore fluid to flow through the internal passageway 7 and contact the chemical material 4 in the internal cavity 8.

FIG. 3 illustrates the reaction 6 of the wellbore/flowbore fluid F and the chemical material 4 in the internal cavity 8 as the wellbore/flowbore fluid F flows into the internal cavity 8 as indicated by the arrow. The reaction 6 of the wellbore/flowbore fluid F and the chemical material 4 generally creates an acid or base that causes the temporary housing 3 to disintegrate, dissolve, degrade, etc.

Figure 4:
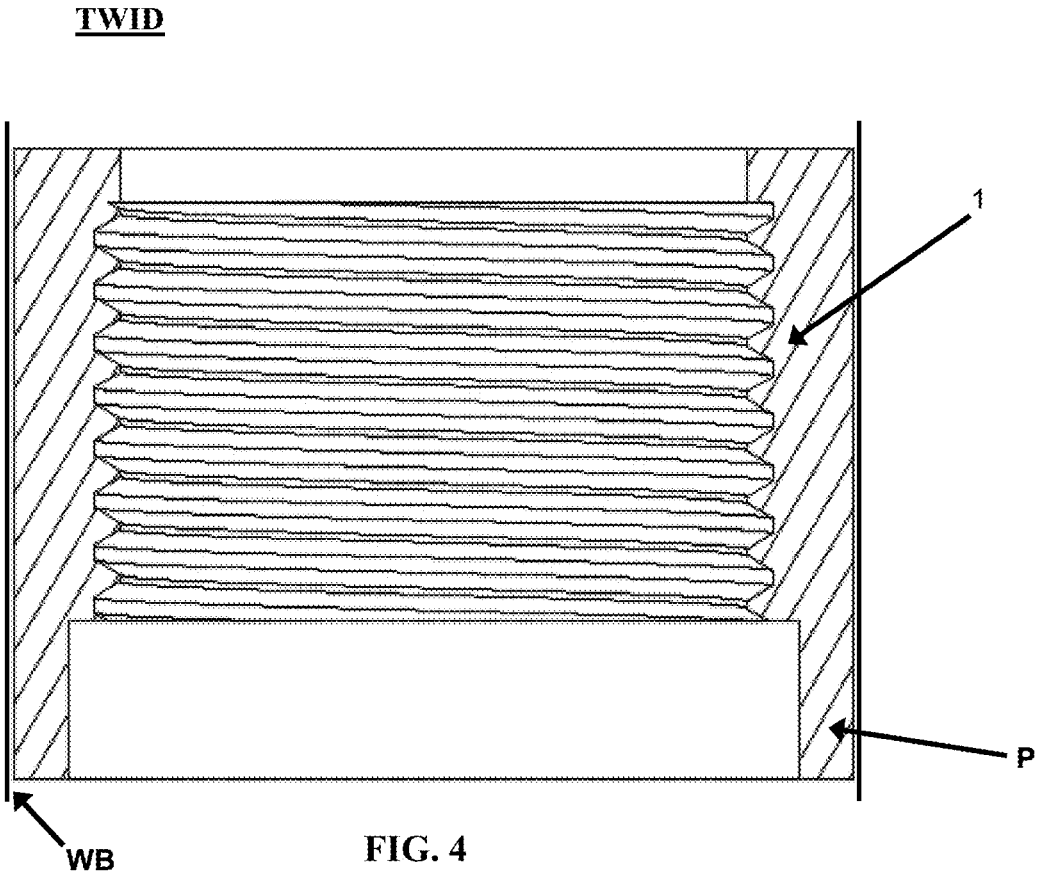
FIG. 4 illustrates the remaining outer housing of the temporary well isolation device after the activation of the chemical material in the cavity has caused the temporary barrier housing of the temporary well isolation device to degrade and/or decompose.

FIG. 4 illustrates the remaining outer housing 1 after the activation of the chemical material 4 has caused the temporary housing 3 to disintegrate, dissolve, degrade, etc. The removal of the temporary housing 3 from the temporary well isolation device TWID results in the free flow of fluid through the wellbore or pipe WB/P.

The one or more chemical materials 4 that can be used include, but are not limited to, one or more acids, buffer compound, base, salt, and/or oxidizer. Non-limiting salts and acids include $NaHSO_4$, $AlCl_3$, $FeCl_3$, NaCl, KCl, $CaCl_2$), NaBr, $AlBr_3$, $BF_3$, $Na_2SO_4$, $AlF_3$, KI, NaI, $ZnCl_2$, $ZnBr_2$, $CuCl_3$, KBr, $MgCl_2$, acids of carboxylic acids (steric acid, benzoic acid, maleic acid, malonic acid, etc.), solid acids such as phosphoric acid, sulfates such as sodium sulfate, sulfur oxide, and acid chloride such as ethonyl chloride, benzoic chloride, and/or other metal salts, and chemical materials disclosed in US 2018/0306027, which is incorporated herein by reference, and any acid, buffer compound, base, salt, or oxidizer. Non-limiting examples of chemical material 4 include sodium bisulfate, aluminum chloride, iron chloride, potassium chloride, sodium chloride, calcium chloride, sodium bromide, magnesium chloride, zinc chloride, copper chloride, etc. One or more of the chemical materials 4 can be partially or fully sealed within the internal cavity 8 (e.g., with optional pressure integrity in the tool body).

Figure 5:
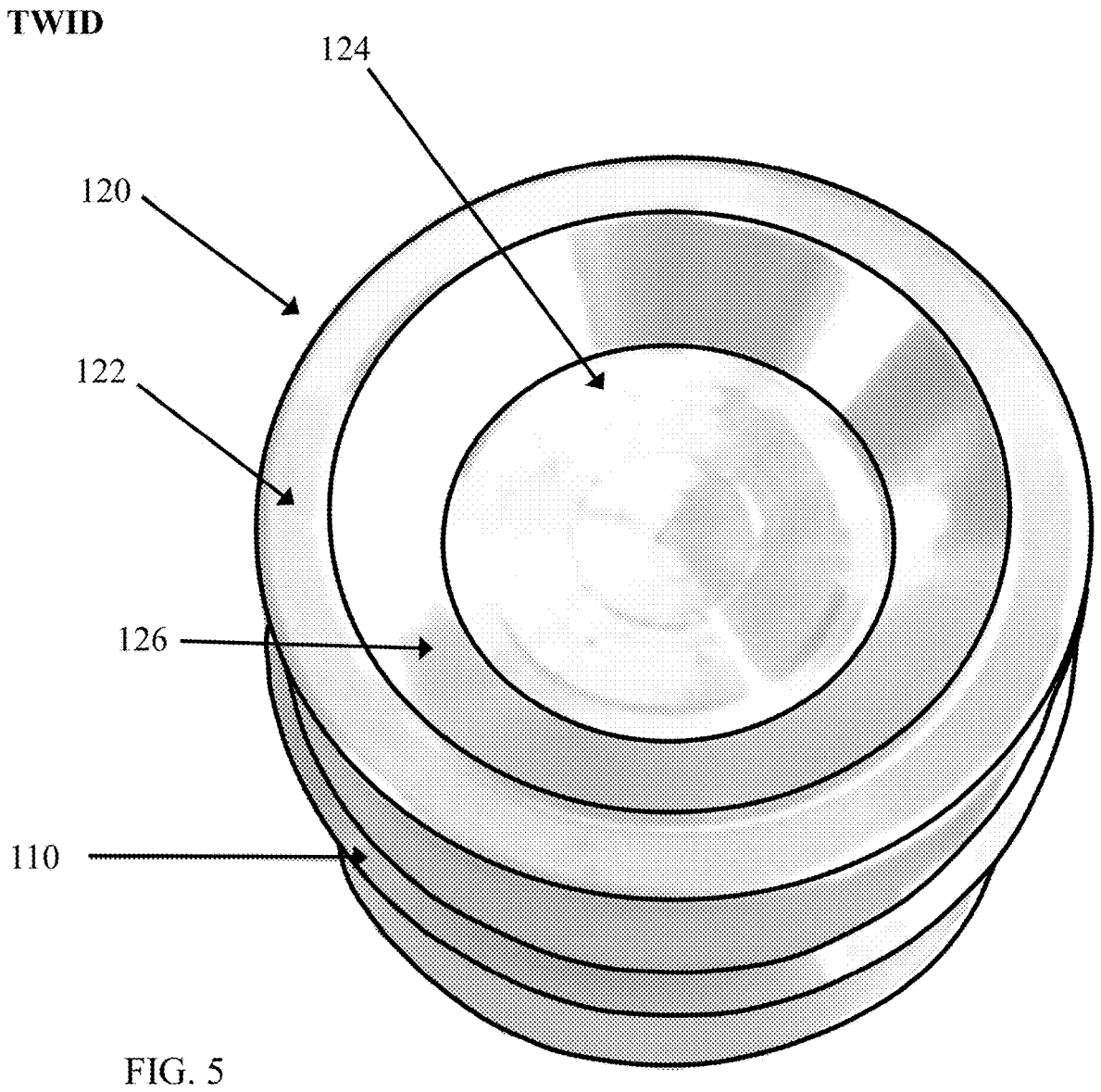
FIG. 5 illustrates a top elevation view of a non-limiting temporary well isolation device in accordance with the present disclosure.
Figure 6:
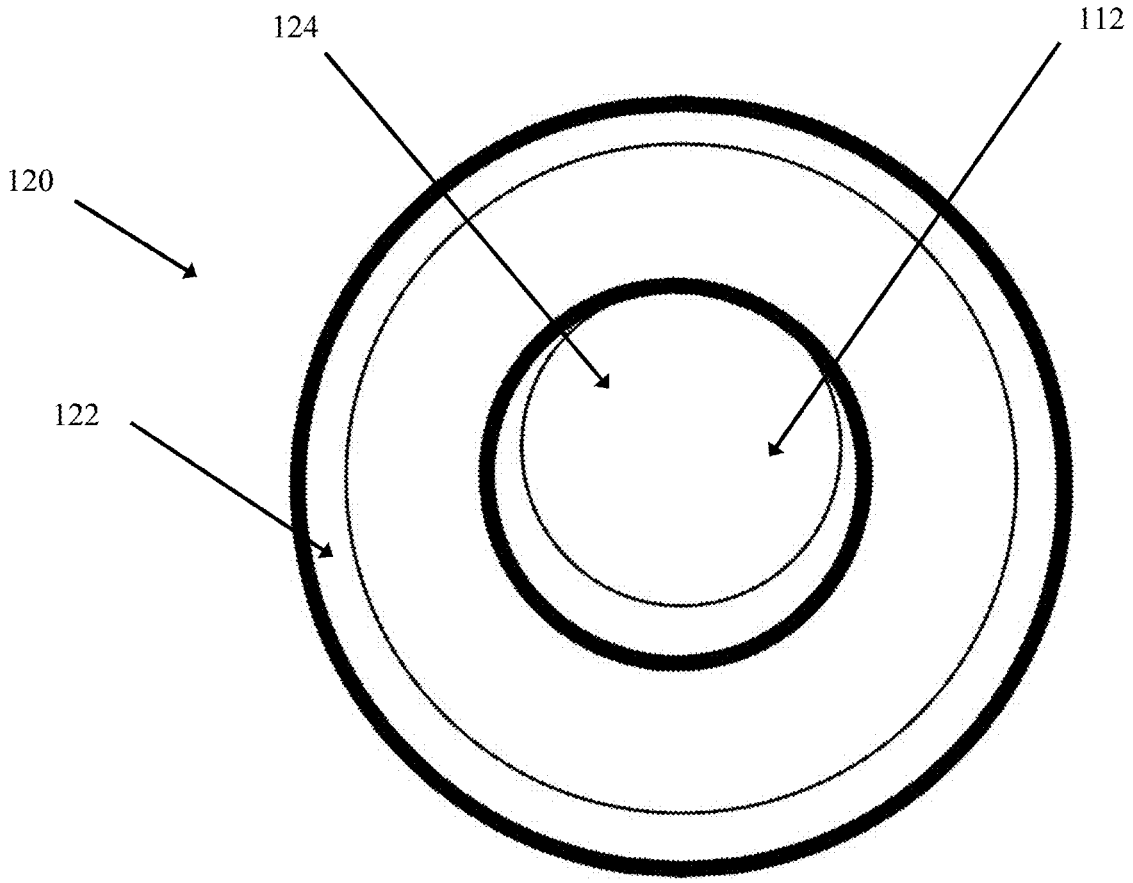
FIG. 6 illustrates a top elevation view of a non-limiting temporary well isolation device of FIG. 5 wherein the central portion is punched-out or sheared from the outer rim portion.
Figure 7:
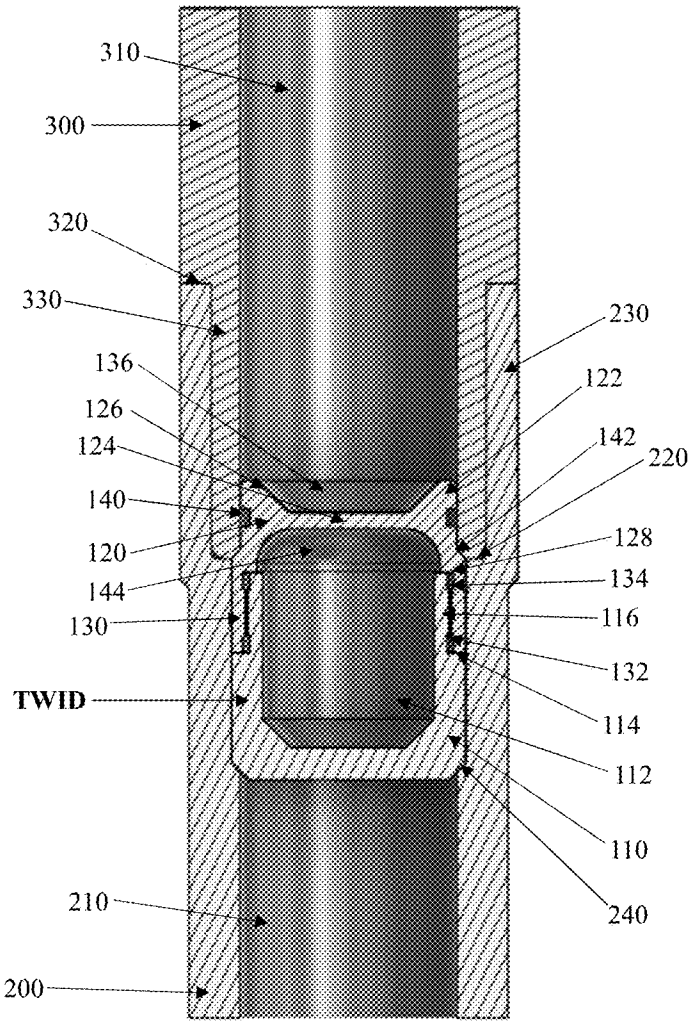
FIG. 7 is a cross-section view of a non-limiting temporary well isolation device that is located between two pipes.

Referring now to FIGS. 5-7, there is illustrated another non-limiting temporary well isolation device TWID that can be used in a temporary wellbore isolation application. The temporary well isolation device TWID includes a temporary housing 110 configured to be connected to, seated on, etc., the tubing P in the well. A lid 120 is connected to the top of the temporary housing 110. The type of connection used is non-limiting. As illustrated in FIG. 7, the temporary housing 110 can optionally include a housing seat 114 and a housing flange 116. The lid 120 includes a lid seat 128 and a lid flange 130. In one non-limiting arrangement, the lid 120 and temporary housing 110 are configured to be connected by a threaded connection; however, this is not required. Generally, the connection forms a fluid seal between the temporary housing 110 and the lid 120. As illustrated in FIG. 7, one or more seals 132, 134 can optionally be used to facilitate in forming a fluid seal between the lid 120 and the temporary housing 110.

The temporary housing 110 includes an inner cavity 112 configured to contain a chemical material (not shown).

The lid 120 includes an outer rim portion 122 and a central portion 124 located within the inner perimeter of the outer rim portion 122. The lid is illustrated as s single-piece component. The outer rim portion has a greater thickness than the central portion 124. As illustrated in FIG. 5, a downward-sloped transition region 126 is formed between the central portion and the outer rim portion 122. The downward-sloped transition region 126 creates a top recess cavity 136 in the top of the lid 120 (as illustrated in FIG. 7). The bottom region of the central portion can also be configured to create a bottom recess cavity 144; however, this is not required. The creation of the top and bottom recess cavities 136, 144 in the lid 120 can be by molding, machining, casting, and/or stamping. When the lid 120 includes a bottom recess cavity 144, the chemical material in the TWID is such that the chemical material is generally only located in the cavity 112 of the temporary housing 110, and is not contained in the bottom recess cavity 114 of the lid 120 when the lid 120 is inserted on the temporary housing 110. Such an arrangement facilitates in the punching-out or shearing of the central portion 124.

Generally, the minimum thickness of the central portion 124 is at least 20% less than a maximum thickness of the outer rim portion 122, and typically the minimum thickness of the central portion 124 is about 20-98% less (and all values and ranges therebetween) than a maximum thickness of the outer rim portion 122, and more typically the minimum thickness of the central portion 124 is about 50-95% less than a maximum thickness of the outer rim portion 122. Generally, the minimum thickness of the central portion 124 is at least 20% less than a maximum thickness of the side walls and/or bottom wall of the temporary housing 110, and typically the minimum thickness of the central portion 124 is about 20-98% less (and all values and ranges therebetween) than a maximum thickness of the side walls and/or bottom wall of the temporary housing 110, and more typically the minimum thickness of the central portion 124 is about 30-95% less than a maximum thickness of the side walls and/or bottom wall of the temporary housing 110.

As illustrated in FIG. 6, the central portion 124 is configured to be punched-out or sheared from the outer rim portion 122 or downward-sloped transition region 126 when the top surface of the central portion 124 is exposed to a fluid pressure that exceeds a certain pressure, or when the top surface of the central portion 124 is contacted with sufficient force by a lance or other similar puncturing device. Table 1 illustrates the burst pressure required to cause the central portion 124 that is formed of a magnesium alloy (e.g., 85+% magnesium, 0.05+% nickel) to be punched-out or sheared as illustrated in FIG. 6.

| Central Portion Sample | Thickness (in.) | Burst Pressure (psi) |
|---|---|---|
| A | 0.055 | 990 |
| B | 0.1245 | 1747 |
| C | 0.124 | 1698 |
| D | 0.123 | 1626 |
| E | 0.174 | 4559 |
| F | 0.174 | 4336 |
| G | 0.174 | 4342 |

As illustrated in TABLE 1, the thickness of the central portion 124 of lid 120 can be fabricated (e.g., machined, molded, stamped, cast, etc.) to be punched-out or sheared above a predetermined pressure. Generally, the predetermined punched-out or shear pressure is less than 15,000 psi, typically 900-14000 psi (and all values and ranges therebetween), and more typically 1500-10,000 psi.

The lid 120 can optionally include a sealing arrangement formed with the interior surface of pipe 300 such as, but not limited to, a sealing ring 140. As can be appreciated, a sealing arrangement can optionally be formed between the temporary housing 110 and the interior surface of pipe 200 (e.g., sealing ring, etc.).

The outer peripheral region of the lid 120 can optionally include an outer seat 142 configured to engage a bottom edge of pipe 300 when pipe 300 is connected to pipe 200. Such an arrangement (when used) facilitates in locking the TWID in position with pipes 200, 300 when such pipes are connected.

Referring now to FIG. 7 which is a more detailed view of the temporary well isolation device TWID located in pipes 200, 300. The TWID is configured to be seated in pipes 200, 300 prior to the pipes being inserted into the wellbore; however, this is not required.

Pipe 200 includes a central cavity 210 that is generally cylindrical shaped. Pipe 200 includes a seat 220, a connection flange 230, and optionally a plug seat 240. Pipe 300 includes a central cavity 310 that is generally cylindrical shaped. Pipe 300 includes a seat 320, and a connection flange 330. Generally, pipes 200 and 300 are connected by a typically threaded connection via connection flanges 230, 330; however, other types of connection arrangement can be used.

The TWID is first inserted into the central cavity 210 such that the bottom side portion of the temporary housing 110 is seated on plug seat 240. Thereafter, pipe 300 is connected to pipe 200 to lock the TWID in position relative to pipes 200, 300. Thereafter, the pipes 200, 300 and the TWID are inserted into a wellbore to temporarily seal the wellbore.

When fluid flow through pipes 200, 300 is required, the TWID can be removed from the pipes 200, 300 by causing the central portion 124 of lid 120 to be punched-out or sheared by applying fluid pressure to the central portion or by some other means (dissolved, disintegrated, etc.).

After the central portion 124 has been punched-out, sheared, or otherwise compromised to allow fluid flow into the internal cavity 112 of the temporary housing 110, the fluid can contact the chemical material in the internal cavity 112 to generally creates an acid or base that causes the temporary housing 110 and lid 120 to disintegrate, dissolve, degrade, etc., thereby resulting in the free flow of fluid through the pipes 200, 300.

Example 1

A temporary well isolation device that is partially or fully formed of a degradable metal serves as a temporary seal in a wellbore. The temporary seal formed by the temporary well isolation device can be optionally designed or configured to allow a vertical casing section to be filled with fluid and/or gas (e.g., air, etc.) in a second section of the tool. Such fluid and/or air provides additional buoyancy to the temporary well isolation device; however, this is not required. The temporary seal can be designed or configured to form a seal between the gas- and water-filled sections until a differential pressure of 2,000 psi is applied to the surface of the temporary well isolation device, thereby causing a plug member in the temporary housing of the temporary well isolation device to burst and/or shear, which bursting and/or shearing of the plug member results in in the exposure of the chemical material contained in the temporary housing of the temporary well isolation device, thereby causing the dissolving and/or degradation of the temporary housing of the temporary well isolation device within a certain time period (e.g., 30 minutes, one hour, two hours, etc.).

Example 2

A temporary well isolation device is partially or fully formed of aluminum and configured to serve as a temporary seal in a tool. The temporary well isolation device includes a cavity that includes aluminum chloride. The temporary well isolation device includes a vertical casing section designed and configured to be filled with fluid (e.g., water, brine, etc.) and gas (e.g. air, etc.) and a temporary seal to seal a second section so that it is more buoyant; however, this is not required. The temporary well isolation device creates a seal between the gas- and fluid-filled sections until a differential pressure of 5,000 psi is applied to a surface on the tool, thereby causing a plug member in the body of the tool to burst and/or shear, which bursting and/or shearing of the plug member results in exposure of the chemical material (e.g., aluminum chloride) contained in the body of the tool to fluid, thereby producing an acid (e.g., hydrochloric acid). The production of the acid results in the lowering of the pH about the body of the tool, thereby causing the dissolving and/or degradation of the body of the tool within a certain time period (e.g., 30 minutes, one hour, two hours, etc.).

Example 3

A temporary well isolation device is partially or fully formed of a structural metal that serves as a temporary seal to allow a vertical casing section to be filled with fluid and gas (e.g., air) that is sealed in a second section so that it is more buoyant; however, this is not required. The temporary well isolation device creates a seal between the gas- and water-filled sections until a lance punctures the body of the plug member, which puncturing of the plug member results in the exposure of the material contained in the temporary housing of the temporary well isolation device, thereby causing the dissolving and/or degradation of the temporary housing of the temporary well isolation device within a certain time period (e.g., 30 minutes, one hour, two hours, etc.).

Example 4

A temporary well isolation device that can be used in a tool, wherein the temporary well isolation device is at least partially made of magnesium. In one non-limiting configuration, the temporary well isolation device has a cavity. In one non-limiting configuration, the plug member of the temporary well isolation device has an outer diameter of 2.375 in. and is 4 in. in length, and plug member wall thickness of is ⅛ in. The cavity in the temporary well isolation device is partially or fully filled which a chemical material (e.g., sodium bisulfate, etc.). The plug member of the temporary well isolation device is design or configured to be pierced or ruptured by a lance, etc., thereby exposing the chemical material to wellbore/flowbore fluid, which creates a highly concentrated acid (e.g., sulfuric acid, etc.). The formed acid causes the rapid corrosion of the magnesium body of the temporary housing of the temporary well isolation device into soluble magnesium sulfate solution at a rate of not less than 0.050 in./hour. Such a corrosion rate can result in the temporary housing of the temporary well isolation device being fully corroded in less than three hours.

Example 5

A temporary well isolation device that can be used in a tool, wherein the temporary well isolation device temporary well isolation device is at least partially made of magnesium. In one non-limiting configuration, the temporary well isolation device has a cavity. In one non-limiting configuration, the plug member has an outer diameter of 2.375 in., a length of 4 in., and the plug member wall a thickness of ⅛ in. The temporary well isolation device has a cavity that is partially or fully filled with a chemical material (e.g., sodium bisulfate, etc.). The plug member is designed or configured to rupture when exposed to a certain pressure threshold (e.g., 500-15,000 psi, etc.). The rupturing of the plug member exposes the chemical material to wellbore/flowbore fluid, which creates a highly concentrated acid (e.g., sulfuric acid, etc.). The formed acid causes the rapid corrosion of the magnesium body into soluble magnesium sulfate solution at a rate of not less than 0.25 in./hour. Such a corrosion rate can result in the temporary housing of the temporary well isolation device being fully corroded in less than 30-60 minutes.

Example 6

A temporary well isolation device in the form of a knockout isolation sub that is designed or configured to isolate tubing from a wellbore. The knockout isolation sub is formed of temporary housing partially or fully made of aluminum and having a pressure-triggered plug member that seals off the cavity in the temporary housing that contains a chemical material. Once the plug member is exposed to a certain threshold pressure, the plug member shears or bursts into the cavity of the temporary housing, thereby causing the chemical material to be exposed to the wellbore/flowbore fluid, which in turn causes the temporary housing to be degraded and/or dissolved, thus opening fluid communication of the temporary well isolation device in the wellbore.

Example 7

A temporary well isolation device in the form of a pump-out plug member that isolates tubing from the wellbore annulus. The pump-out plug member is partially or fully formed of a degradable magnesium or magnesium alloy. The pump-out plug member is designed or configured to begin degrading or dissolving when exposed to a certain temperature threshold, thereby causing the chemical material in the cavity of the pump-out plug member to be exposed to the flowbore fluid, which in turn causes the pump-out plug member to be degraded and/or dissolved, thus opening fluid communication of the tool in the wellbore.

Example 8

A temporary well isolation device in the form of a pump-out plug member that is partially or fully formed of aluminum or aluminum alloy. The pump-out plug member is configured to be held in position relative to the tool by one or more shear pins. The pump-out plug member includes a cavity that partially or fully contains a chemical material (e.g., sodium bisulfate, etc.). Once the plug member of the pump-out plug member is exposed to a certain threshold pressure, the shear pins holding the plug member of the pump-out plug member in place will shear, thereby causing the chemical material to be exposed to the flowbore or wellbore fluids, thereby causing acid (e.g., sulfuric acid, etc.) to be formed, causing the remaining pump-out plug member body to degrade or dissolve.

Example 9

A temporary well isolation device that is partially or fully formed of a structural metal that contains a chemical material. The temporary well isolation device is designed or configured to serve as a temporary seal to allow a vertical casing section with fluid (e.g., water, brine, etc.) and gas (e.g., air, etc.) to be sealed in a second section so that it is more buoyant; however, this is not required. The temporary well isolation device creates a seal between the gas- and fluid-filled sections until a wireline triggers an explosive charge on the plug member on the temporary well isolation device, thereby exposing a contained chemical material to dissolve or degrade the temporary housing of the temporary well isolation device within a certain time period (e.g., 10-60 minutes, etc.).

It will thus be seen that the objects set forth above, among those made apparent from the preceding description, are efficiently attained, and since certain changes may be made in the constructions set forth without departing from the spirit and scope of the disclosure, it is intended that all matter contained in the above description and shown in the accompanying drawings shall be interpreted as illustrative and not in a limiting sense. The disclosure has been described with reference to preferred and alternate embodiments. Modifications and alterations will become apparent to those skilled in the art upon reading and understanding the detailed discussion of the disclosure provided herein. This disclosure is intended to include all such modifications and alterations insofar as they come within the scope of the present disclosure. It is also to be understood that the following claims are intended to cover all of the generic and specific features of the disclosure herein described and all statements of the scope of the disclosure, which, as a matter of language, might be said to fall there between. The disclosure has been described with reference to the preferred embodiments. These and other modifications of the preferred embodiments as well as other embodiments of the disclosure will be obvious from the disclosure herein, whereby the foregoing descriptive matter is to be interpreted merely as illustrative of the disclosure and not as a limitation. It is intended to include all such modifications and alterations insofar as they come within the scope of the appended claims.

What is claimed:

1. A pipe system that includes a temporary well isolation device that is adapted to be positioned in a subterranean well; said pipe system comprises:

a. a first pipe has a first end;

b. a second pipe has a first end; and c. a temporary well isolation device positioned between said first end of said first pipe and said first end of said second pipe; said temporary well isolation device includes:

i. an outer housing; said outer housing has a housing cavity;

ii. a temporary housing that is at least partially positioned in said housing cavity when said temporary housing is connected to said outer housing; said temporary housing includes an interior passageway along a longitudinal axis of said temporary housing and an internal cavity connected to said interior passageway; said interior passageway has a passageway cross-sectional area at a location where said interior passageway terminates in said internal cavity; said passageway cross-sectional area is less than a cross-sectional area of said internal cavity at a location that is below said location that said interior passageway terminates in said internal cavity; said temporary housing is partially or fully formed of a structural material that can be degraded and/or dissolved; said internal cavity constitutes 55-90 vol. % of said temporary housing;

iii. a chemical material located in said internal cavity; said chemical material formed of a material that when exposed to flowbore or wellbore fluid will cause said structural material to degrade and/or dissolve; and iv. a temporary barrier or plug member sealing said interior passageway, and wherein said temporary barrier or plug member is configured to be partially or fully removed or dislodged from said temporary housing to allow fluid to flow through said interior passageway and to contact said chemical material in said internal cavity; and wherein fluid is prevented from flowing from said first pipe, through said temporary well isolation device, and then into said second pipe when said temporary barrier or plug member is not removed or dislodged from said temporary housing; and wherein fluid is allowed to flow from said first end of said first pipe, through said temporary well isolation device, and then into said second pipe via said first end of said second pipe after said temporary barrier or plug member is partially or fully removed or dislodged from said temporary housing.

2. The pipe system as defined in claim 1, wherein said temporary housing includes an outer surface has a connection arrangement; said connection arrangement configured to temporarily or releasably connect said temporary housing to the outer housing.

3. The pipe system as defined in claim 1, wherein said structural material includes one or more of magnesium, magnesium alloy, zinc, zinc alloy, aluminum, aluminum alloy, and polymer.

4. The pipe system as defined in claim 1, wherein said chemical material includes one or more salts that can be formed into a base when exposed to flowbore or wellbore fluid, or one or more salts that can be formed into an acid when exposed to flowbore or wellbore fluid.

5. The pipe system as defined in claim 4, wherein said chemical material includes one or more of $NaHSO_4$, $AlCl_3$, $FeCl_3$, NaCl, KCl, $CaCl_2$, NaBr, $AlBr_3$, $BF_3$, $AlF_3$, KI, NaI, $ZnCl_2$, $ZnBr_2$, and $CuCl_3$, wherein the chemical material is a water-soluble acid, buffer compound, base, salt, and/or oxidizer.

6. The pipe system as defined in claim 1, wherein said temporary barrier or plug member is configured to be partially or fully removed or dislodged from said temporary housing by an activation/trigger mechanism; said activation/trigger mechanism includes one or more of: a) mechanically causing said temporary barrier or plug member to move to an open position; b) using a motor or other device to cause said temporary barrier or plug member to move to an open position; c) applying an external pressure pulse or pulses to said temporary barrier or plug member to cause said temporary barrier or plug member to move, disintegrate, dissolve, degrade, fracture, and/or be expelled; d) increasing or decreasing the temperature about said temporary barrier or plug member to cause the temporary barrier or plug member to move, disintegrate, dissolve, degrade, fracture, and/or be expelled, etc.; e) using a dissolvable or degradable component that partially or fully forms said temporary barrier or plug member, which dissolvable or degradable component is compromised by said wellbore/flowbore fluid so as to cause the temporary barrier or plug member to partially or fully disintegrate, dissolve, and/or degrade; f) using a dissolvable or degradable component that partially or fully forms said temporary barrier or plug member which dissolvable or degradable component that is compromised by changes in the composition, pH and/or acidity of the wellbore/flowbore fluid to cause said temporary barrier or plug member to partially or fully disintegrate, dissolve, and/or degrade; g) applying an electrical pulse or pulses to said temporary barrier or plug member to cause said temporary barrier or plug member to move, disintegrate, dissolve, degrade, fracture, and/or be expelled; h) including a mechanical device in said temporary barrier or plug member, which mechanical device can be activated downhole or at some location on the surface so as to cause said temporary barrier or plug member to open; i) using an explosive device that is positioned on and/or near said temporary barrier or plug member, which explosion device can be used to cause said temporary barrier or plug member to move, fracture, disintegrate, and/or be expelled; j) providing said temporary barrier or plug member that is partially or fully coated with a coating material that is formulated to controllably degrade, dissolve, or otherwise become compromised in a presence of said wellbore/flowbore fluid, wherein the degrading, dissolving, and/or compromising of said coating material allows said wellbore/flowbore fluid to I) flow through said temporary barrier or plug member and/or II) contact other materials that form said temporary barrier or plug member to cause such other materials to disintegrate, dissolve, and/or degrade when exposed to said wellbore/flowbore fluid; and/or k) applying an ultrasonic pulse or pulses to said temporary barrier or plug member to cause said temporary barrier or plug member to move, disintegrate, dissolve, degrade, fracture, and/or be expelled.

7. The pipe system as defined in claim 1, wherein said temporary barrier or plug member is coated by a material that delays and/or induces degradation of certain parts of said temporary barrier or plug member in a certain direction and/or region on said temporary barrier or plug member.

8. The pipe system as defined in claim 1, wherein said internal cavity in the temporary housing is the only cavity that includes said chemical material.

9. The pipe system as defined in claim 1, wherein said passageway cross-sectional area is less than a cross-sectional area of said internal cavity at any location that is below said location that said interior passageway terminates in said internal cavity.

10. A pipe system that includes a temporary well isolation device that is adapted to be positioned in a subterranean well; said pipe system comprises:

a. a first pipe has a first end;

b. a second pipe has a first end; and c. a temporary well isolation device positioned between said first end of said first pipe and said first end of said second pipe; said temporary well isolation device includes:

i. an outer housing; said outer housing has a housing cavity;

ii. a temporary housing that is at least partially positioned in said housing cavity when said temporary housing is connected to said outer housing; said temporary housing includes an interior passageway along a longitudinal axis of said temporary housing and an internal cavity connected to said interior passageway; said interior passageway has a passageway cross-sectional area at a location where said interior passageway terminates in said internal cavity; said passageway cross-sectional area is less than a cross-sectional area of said internal cavity at a location that is below said location that said interior passageway terminates in said internal cavity; said temporary housing is partially or fully formed of a structural material that can be degraded and/or dissolved; said temporary housing includes an outer surface has a connection arrangement; said connection arrangement configured to temporarily or releasably connect said temporary housing to the outer housing; said connection arrangement on said outer surface of said temporary housing includes a threaded surface that is configured to engage a threaded surface on the outer housing;

iii. a chemical material located in said internal cavity; said chemical material formed of a material that when exposed to flowbore or wellbore fluid will cause said structural material to degrade and/or dissolve; and iv. a temporary barrier or plug member sealing said interior passageway, and wherein said temporary barrier or plug member is configured to be partially or fully removed or dislodged from said temporary housing to allow fluid to flow through said interior passageway and to contact said chemical material in said internal cavity.

11. A method of controlling fluid flow through a pipe system using a temporary well isolation device, said method comprises:

a. providing a temporary well isolation device that is located between a first end of a first pipe and a first end of a second pipe; said temporary well isolation device includes:

i. an outer housing; said outer housing has a housing cavity;

ii. a temporary housing that is at least partially positioned in said housing cavity when said temporary housing is connected to said outer housing; said temporary housing includes an interior passageway along a longitudinal axis of said temporary housing and an internal cavity connected to said interior passageway; said interior passageway has a passageway cross-sectional area at a location where said interior passageway terminates in said internal cavity; said passageway cross-sectional area is less than a cross-sectional area of said internal cavity at a location that is below said location that said interior passageway terminates in said internal cavity; said temporary housing is partially or fully formed of a structural material that can be degraded and/or dissolved; said internal cavity constitutes 55-90 vol. % of said temporary housing;

iii. a chemical material located in said internal cavity; said chemical material formed of a material that when exposed to flowbore or wellbore fluid will cause said structural material to degrade and/or dissolve; and iv. a temporary barrier or plug member sealing said interior passageway;

b. positioning said temporary well isolation device and said first end of said first pipe and said first end of said second pipe within a subterranean well; said temporary well isolation device configured to block fluid flow between said first and second pipes when said temporary barrier or plug member is not removed or dislodged from said temporary housing, and c. causing corrosion, dissolution, and/or degradation of one or more components of said temporary well isolation device to cause partial or full removal or dislodgement of said temporary barrier or plug member from said temporary housing and to thereafter allow fluid flow between said first and second pipes.

12. The method as defined in claim 11, wherein said temporary barrier or plug member is configured to be partially or fully removed or dislodged from said temporary housing to allow fluid to flow through said interior passageway and to contact said chemical material in said internal cavity.

13. The method as defined in claim 11, wherein said step of causing corrosion, dissolution, and/or degradation includes causing fluid to contact said chemical material in said internal cavity of said temporary well isolation device to cause said chemical material to dissolve, degrade, and/or corrode one or more portions of said temporary well isolation device.

14. The method as defined in claim 11, wherein said step of causing corrosion, dissolution, and/or degradation includes exposing a temporary barrier or plug member on said temporary well isolation device to a pressurized fluid source, wherein said pressurized fluid source causes movement of said temporary barrier or plug member which enables fluid to contact a chemical material in said temporary well isolation device, said fluid includes an aqueous solution.

15. The method as defined in claim 11, wherein said temporary housing including an outer surface has a connection arrangement; said connection arrangement configured to temporarily or releasably connect said temporary housing to the outer housing.

16. The method as defined in claim 11, wherein said structural material includes one or more of magnesium, magnesium alloy, zinc, zinc alloy, aluminum, aluminum alloy, and polymer.

17. The method as defined in claim 11, wherein said chemical material includes one or more salts that can be formed into a base when exposed to flowbore or wellbore fluid, or one or more salts that can be formed into an acid when exposed to flowbore or wellbore fluid.

18. The method as defined in claim 17, wherein said chemical material includes one or more of $NaHSO_4$, $AlCl_3$, $FeCl_3$, NaCl, KCl, $CaCl_2$, NaBr, $AlBr_3$, $BF_3$, $AlF_3$, KI, NaI, $ZnCl_2$, $ZnBr_2$, and $CuCl_3$, wherein the chemical material is a water-soluble acid, buffer compound, base, salt, and/or oxidizer.

19. The method as defined in claim 11, wherein said temporary barrier or plug member is coated by a material that delays and/or induces degradation of certain parts of said temporary barrier or plug member in a certain direction and/or region on said temporary barrier or plug member.

20. The method as defined in claim 11, wherein said internal cavity in the temporary housing is the only cavity that includes said chemical material.

21. The method as defined in claim 11, wherein said passageway cross-sectional area is less than a cross-sectional area of said internal cavity at any location that is below said location that said interior passageway terminates in said internal cavity.

22. A method of controlling fluid flow through a pipe system using a temporary well isolation device, said method comprises:

a. providing a temporary well isolation device that is located between a first end of a first pipe and a first end of a second pipe; said temporary well isolation device includes:

i. an outer housing; said outer housing has a housing cavity;

ii. a temporary housing that is at least partially positioned in said housing cavity when said temporary housing is connected to said outer housing; said temporary housing includes an interior passageway along a longitudinal axis of said temporary housing and an internal cavity connected to said interior passageway; said interior passageway has a passageway cross-sectional area at a location where said interior passageway terminates in said internal cavity; said passageway cross-sectional area is less than a cross-sectional area of said internal cavity at a location that is below said location that said interior passageway terminates in said internal cavity; said temporary housing is partially or fully formed of a structural material that can be degraded and/or dissolved; said temporary housing includes an outer surface has a connection arrangement; said connection arrangement configured to temporarily or releasably connect said temporary housing to the outer housing; said connection arrangement on said outer surface of said temporary housing includes a threaded surface that is configured to engage a threaded surface on the outer housing;

iii. a chemical material located in said internal cavity; said chemical material formed of a material that when exposed to flowbore or wellbore fluid will cause said structural material to degrade and/or dissolve; and iv. a temporary barrier or plug member sealing said interior passageway;

b. positioning said temporary well isolation device and said first end of said first pipe and said first end of said second pipe within a subterranean well; said temporary well isolation device configured to block fluid flow between said first and second pipes when said temporary barrier or plug member is not removed or dislodged from said temporary housing, and c. causing corrosion, dissolution, and/or degradation of one or more components of said temporary well isolation device to cause partial or full removal or dislodgement of said temporary barrier or plug member from said temporary housing and to thereafter allow fluid flow between said first and second pipes.

* * * * *